US007940460B2

(12) United States Patent
Braunstein et al.

(10) Patent No.: US 7,940,460 B2
(45) Date of Patent: May 10, 2011

(54) LIGHT SHELF ASSEMBLY AND METHODS OF INSTALLING THE SAME

(75) Inventors: Richard Braunstein, Marietta, GA (US); Donald G. Pangburn, McDonough, GA (US); Michael D. Oliver, Tyrone, GA (US)

(73) Assignee: YKK Corporation of America, Marietta, GA (US)

( * ) Notice: Subject to any disclaimer, the term of this patent is extended or adjusted under 35 U.S.C. 154(b) by 176 days.

(21) Appl. No.: 12/371,024

(22) Filed: Feb. 13, 2009

(65) Prior Publication Data

US 2010/0208454 A1 Aug. 19, 2010

(51) Int. Cl.
*G02B 17/00* (2006.01)
*G02B 27/00* (2006.01)

(52) U.S. Cl. ..... 359/591; 359/596; 52/78

(58) Field of Classification Search ..... 359/591, 359/596; 52/78, 473

See application file for complete search history.

(56) References Cited

U.S. PATENT DOCUMENTS

| | | | | |
|---|---|---|---|---|
| 595,265 | A * | 12/1897 | Ewen | 359/591 |
| 897,775 | A | 9/1908 | Penfound | |
| 1,916,397 | A | 7/1933 | Unger | |
| 4,347,795 | A | 9/1982 | Mäkinen | |
| 4,441,771 | A | 4/1984 | Roesler | |
| 4,899,491 | A * | 2/1990 | Okumoto | 359/596 |
| 5,590,607 | A * | 1/1997 | Howard | 108/98 |
| 5,738,019 | A | 4/1998 | Parker | |
| 5,802,784 | A * | 9/1998 | Federmann | 359/596 |
| 6,239,910 | B1 | 5/2001 | Digert | |
| 6,435,634 | B1 | 8/2002 | Webb et al. | |
| 6,480,336 | B2 | 11/2002 | Digert et al. | |
| 6,542,303 | B1 * | 4/2003 | Oyama | 359/591 |
| 6,714,352 | B2 | 3/2004 | Rogers et al. | |
| 6,799,523 | B1 | 10/2004 | Cunha | |
| 6,988,525 | B2 | 1/2006 | Moulton | |
| 2002/0198438 | A1 | 12/2002 | Cromer et al. | |

FOREIGN PATENT DOCUMENTS

| | | |
|---|---|---|
| WO | WO 00/47859 | 8/2000 |

OTHER PUBLICATIONS

BrightShelf™ Installation instructions © 2010.*
InLighten, *InLighten* (*Light Shelf*), www.kawneer.com, Jun. 2007.
"Light Shelves," www.azusasekkei.jp/AzusaSekkei_ehtmal/service/env_03.html, retrieved on Dec. 3, 2008.

* cited by examiner

*Primary Examiner* — Christopher Mahoney
(74) *Attorney, Agent, or Firm* — Kilpatrick Townsend & Stockton LLP

(57) ABSTRACT

Various embodiments provide a modular light shelf assembly in which individual light shelf units are substantially prefabricated. For example, in various embodiments, the assembly includes pre-fabricated support arms that are secured adjacent an interior wall of a building adjacent a window opening. Each of the support arms define at least one channel, and each light shelf includes at least one protrusion extending from each of a first side and a second side of the light shelf. The protrusion on the first side of the light shelf slidably engages the channel of the support arm adjacent the first side of the light shelf, and the protrusion on the second side of the light shelf slidably engages the channel on the support arm adjacent the second side of the light shelf to secure the light shelf between the adjacent support arms.

32 Claims, 20 Drawing Sheets

LIGHT SHELF ASSEMBLY AND METHODS OF INSTALLING THE SAME

BACKGROUND OF THE INVENTION

With the emergence of green building practices, architects are continually seeking sun control strategies to improve the overall performance of the building envelope. The use of sunshades, often in conjunction with interior light shelves, are two such strategies. Most light shelves are long, continuous expanses of cantilevered material and necessitate onsite construction. The light shelves reflect sunlight coming into a room of a building through a window, for example, upwardly toward the ceiling of the room.

The installation and maintenance of these conventional light shelves present a number of potential problems. For example, the cost of field labor is typically significantly greater than shop labor, and these conventional light shelves are not typically prefabricated. In addition, attaching fixed sized panels to vertical mullions or vertical wall studs that are not perfectly spaced creates potential alignment problems during installation. Furthermore, interior panels tend to gather dust, which diminishes the performance of the reflective upper surface of the panel. With conventional light shelves, it is difficult or sometimes impossible to access the upper surface.

BRIEF SUMMARY OF VARIOUS EMBODIMENTS OF THE INVENTION

Various embodiments of the invention include a light shelf assembly that includes: (1) two or more support arms spaced apart substantially horizontally along an interior wall of a building and (2) at least one light shelf comprising a substantially planar base portion and at least one protrusion that extends outwardly from each of first and second side surfaces of the base portion, which are opposite and spaced apart from each other. Each support arm has a first end and a second end. The first end is secured to the interior wall, and the second end extends away from the interior wall. In addition, each support arm defines at least one channel along an outer surface of the support arm, and the channel defines an opening that is at least partially within a horizontal plane that extends between two adjacent support arms. The at least one protrusion extending from the first side surface slidably engages the channel of the support arm adjacent the first side surface, and the at least one protrusion extending from the second side surface slidably engages the channel of the support arm adjacent the second side surface such that a back edge surface of the base portion is disposed adjacent the first ends of the support arms, a front edge surface of the base portion is disposed adjacent the second ends of the support arms, and the light shelf is suspended between the support arms.

In various embodiments, the at least one protrusion includes: (1) at least one pin that extends from each side surface of the base portion and is disposed adjacent a back edge surface of the base portion and (2) an elongated rail that extends from each side surface of the base portion and is disposed between the pin and the front edge surface of the base portion. In another embodiment, the at least one protrusion includes at least two pins that extend from each side surface of the base portion. And, in yet another embodiment, the at least one protrusion includes an elongated rail that extends along each side surface.

Various other embodiments include a light shelf assembly that includes: (1) two or more support arms spaced apart substantially horizontally along an interior wall of a building and (2) at least one light shelf that includes a substantially planar base portion having a first side surface and second side surface, which are opposite and spaced apart from each other. Each of the two or more support arms define at least one protrusion that extends radially outwardly from an outer surface of the support arm, and each protrusion is substantially within a horizontal plane that extends between two adjacent support arms. In addition, each support arm has a first end and a second end. The first end is secured to the interior wall, and the second end is spaced apart from the interior wall. In addition, each side surface of the base portion defines at least one channel that extends along a length of the side surface, and each of the channels define an opening. The at least one protrusion extending from the support arm adjacent the first side surface is slidably engaged into the opening defined by the at least one channel defined on the first side surface, and the at least one protrusion extending from the support arm adjacent the second side surface is slidably engaged into the opening of the at least one channel defined on the second side surface such that a back edge surface of the base portion is disposed adjacent the first ends of the support arms, a front edge surface of the base portion is disposed adjacent the second ends of the support arms, and the light shelf is suspended between the support arms.

Various embodiments of the invention include a method of assembling a light shelf assembly. The method includes the steps of: (1) providing at least two support arms, wherein each support arm has a first end and a second end, and each support arm defines at least one channel extending from the second end toward the first end; (2) providing at least one light shelf that includes a substantially planar base portion and at least one protrusion extend outwardly from each of a first side and a second side of the base portion, wherein the second side is opposite and spaced apart from the first side; (3) securing the first ends of the support arms to an interior wall of a building such that the support arms are spaced apart horizontally along the interior wall and an opening defined by the channel is within a horizontal plane that extends between two adjacent support arms; and (4) slidably disposing the protrusion extending from the first side surface in the channel of the support arm adjacent the first side surface and the protrusion extending from the second side surface in the channel of the support arm adjacent the second side surface such that the back edge surface of the base portion is disposed adjacent the first ends of the support arms, the front edge surface of the base portion is disposed adjacent the second ends of the support arms, and the light shelf is suspended between the support arms. In a particular embodiment, the at least one protrusion includes a first pin and a second pin that extend from each side surface of the base portion, wherein the first pins are adjacent the back edge surface of the base portion and the second pins are adjacent the front edge surface of the base portion. In addition, the method further includes the step of slidably disengaging the second pins from the channels of the support arms and rotating the light shelf about the first pins. Such an embodiment provides access to an upper surface of the light shelf without having to remove the light shelf from the assembly.

BRIEF DESCRIPTION OF THE DRAWINGS

Figure 1:
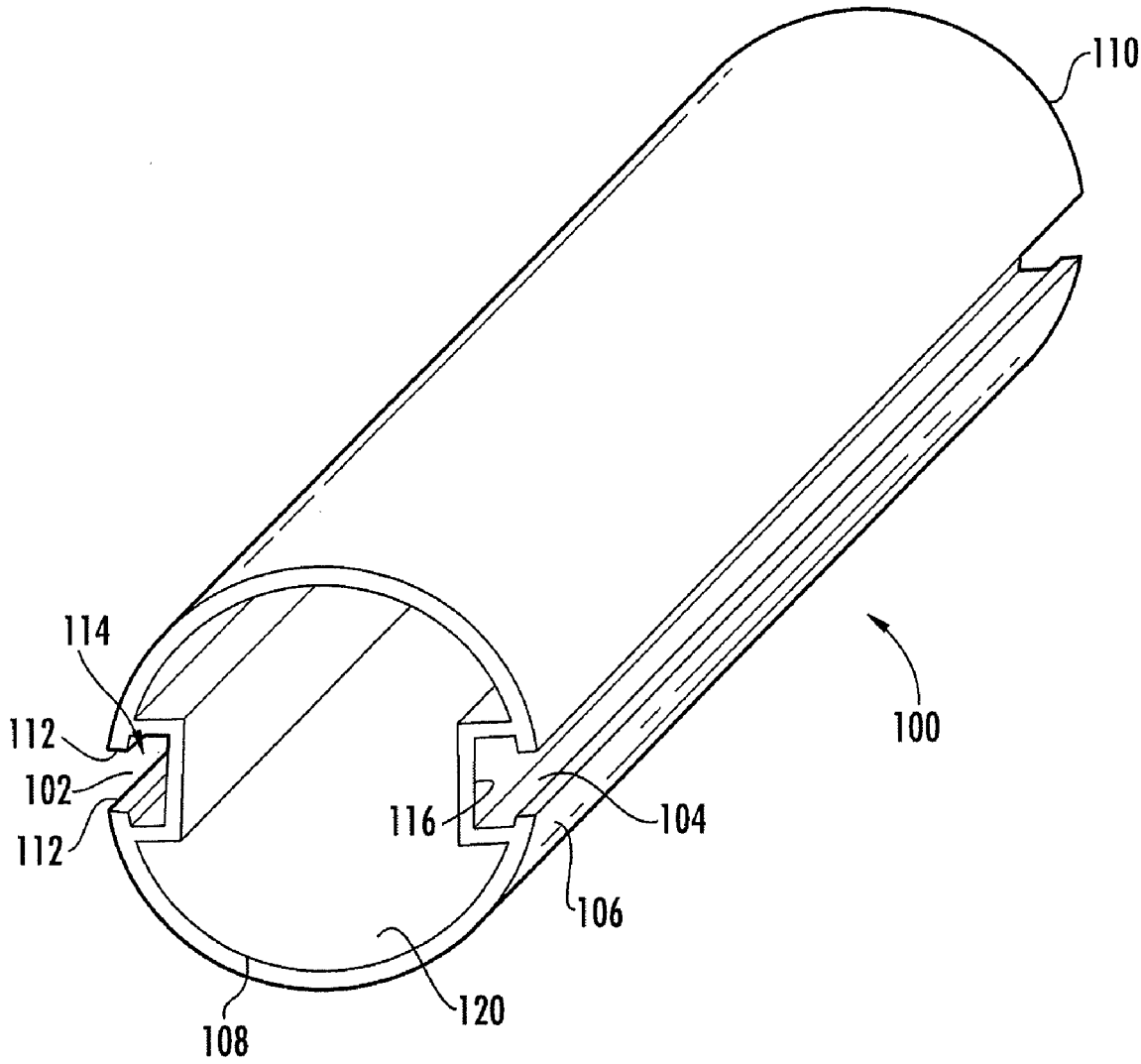

Having thus described various embodiments of the invention in general terms, reference will now be made to the accompanying drawings, which are not necessarily drawn to scale, and wherein:

FIG. 1 illustrates a perspective view of a support arm according to one embodiment of the invention.

Figure 2:
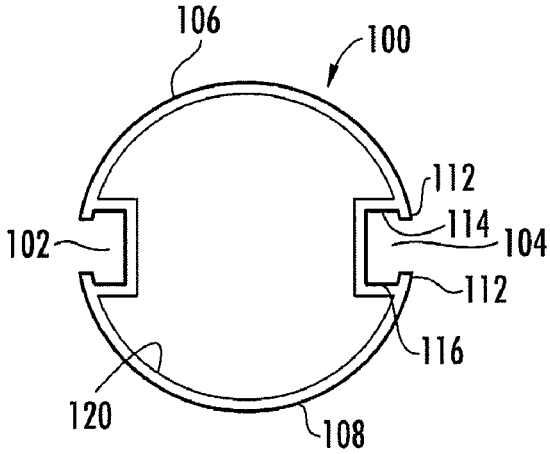

FIG. 2 illustrates an end view of the support arm shown in FIG. 1.

Figure 3:
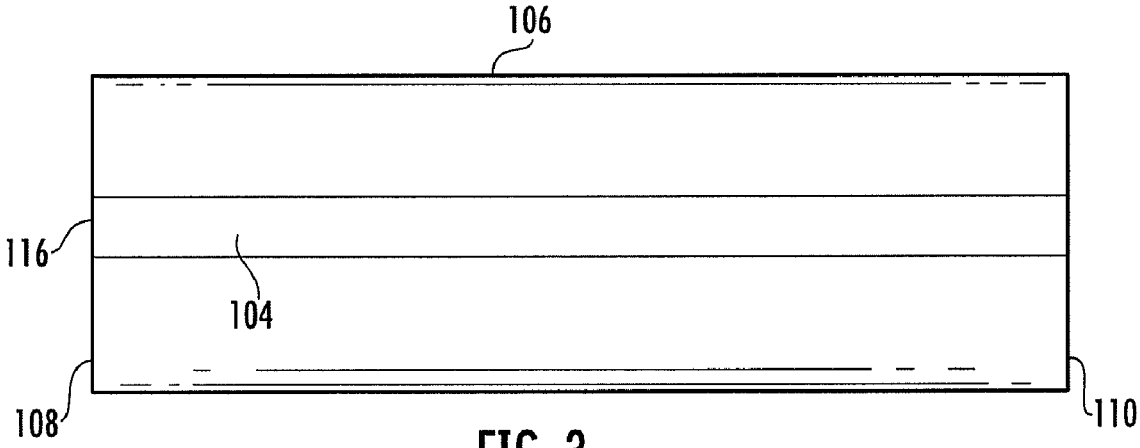

FIG. 3 illustrates a side view of the support arm shown in FIG. 1.

Figure 4:
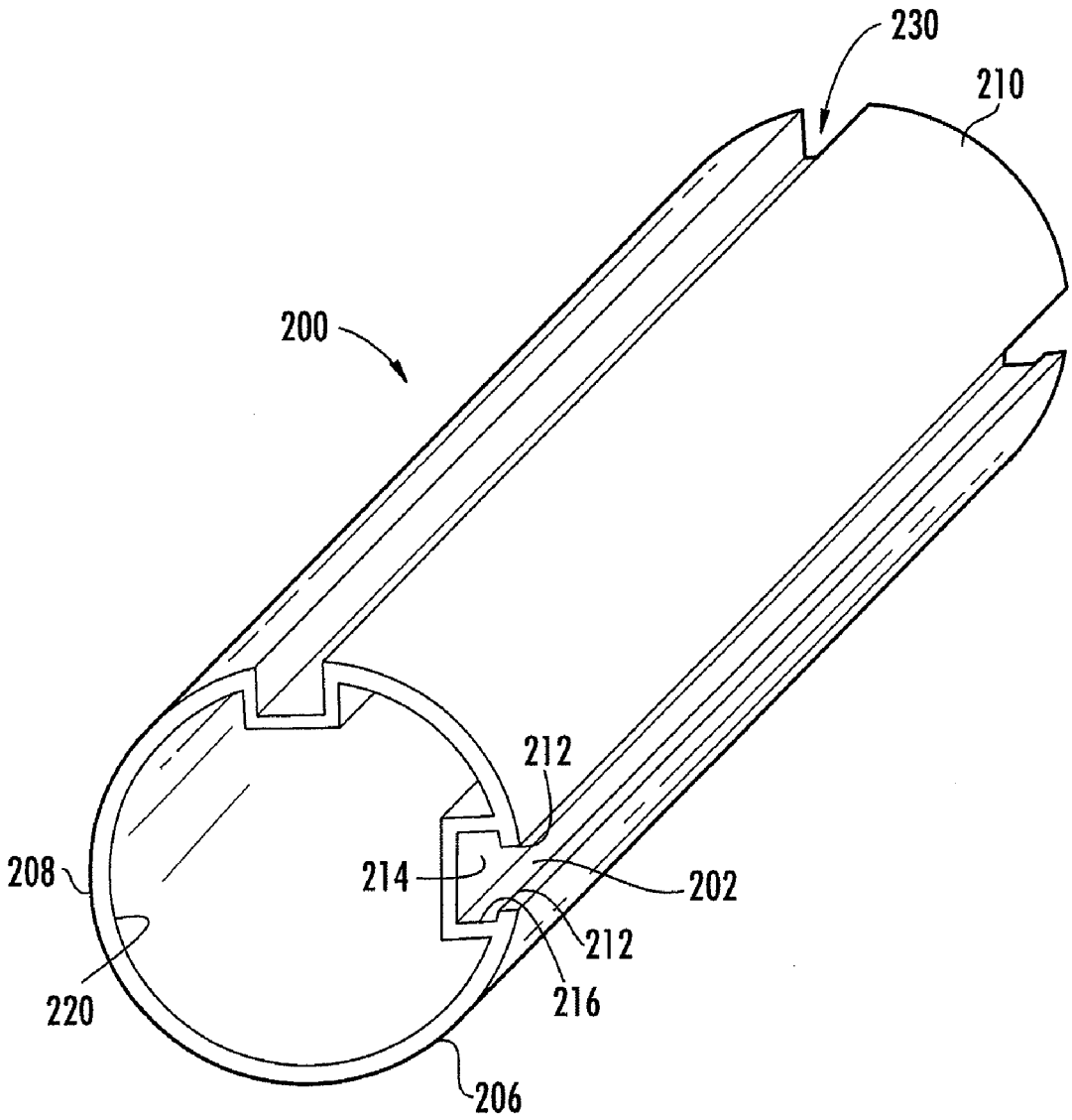

FIG. 4 illustrates a perspective view of a support arm according to another embodiment of the invention.

Figure 5:
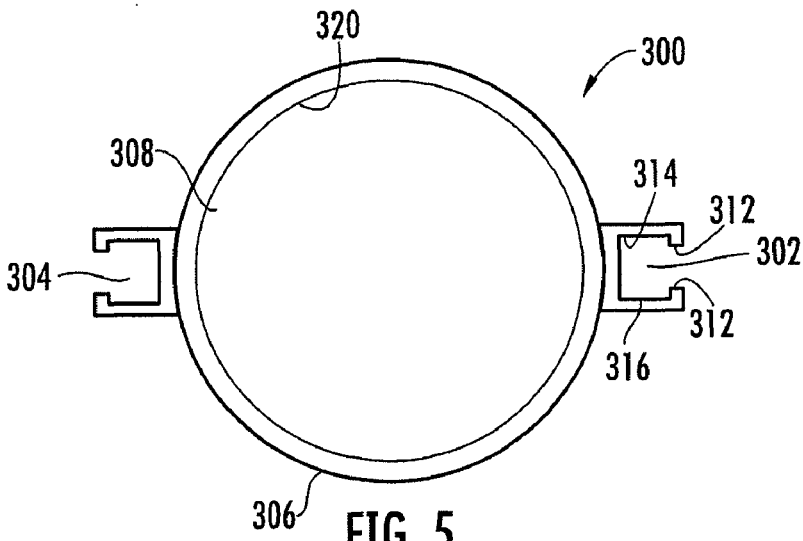

FIG. 5 illustrates an end view of a support arm according to yet another embodiment of the invention.

Figure 6:
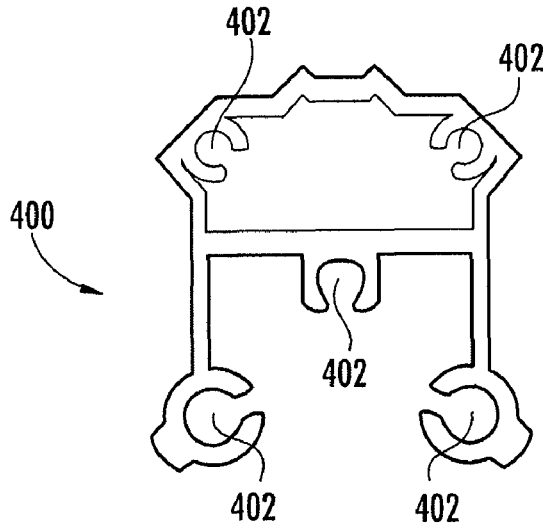

FIG. 6 illustrates a reinforcement member according to one embodiment of the invention.

Figure 7:
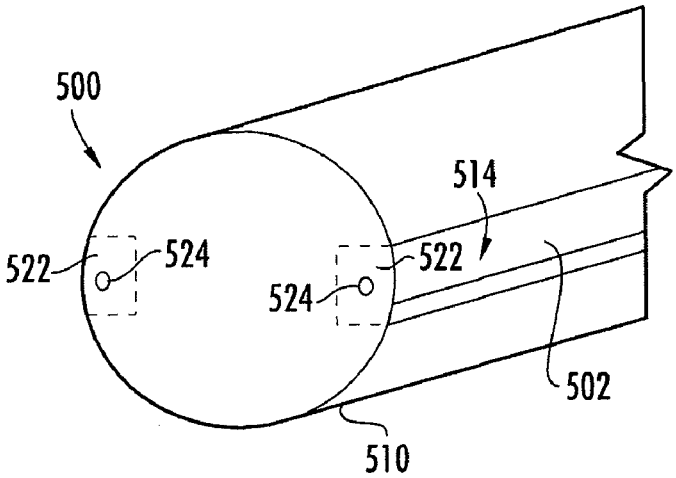

FIG. 7 illustrates a perspective view of a support arm according to another embodiment of the invention.

Figure 8:
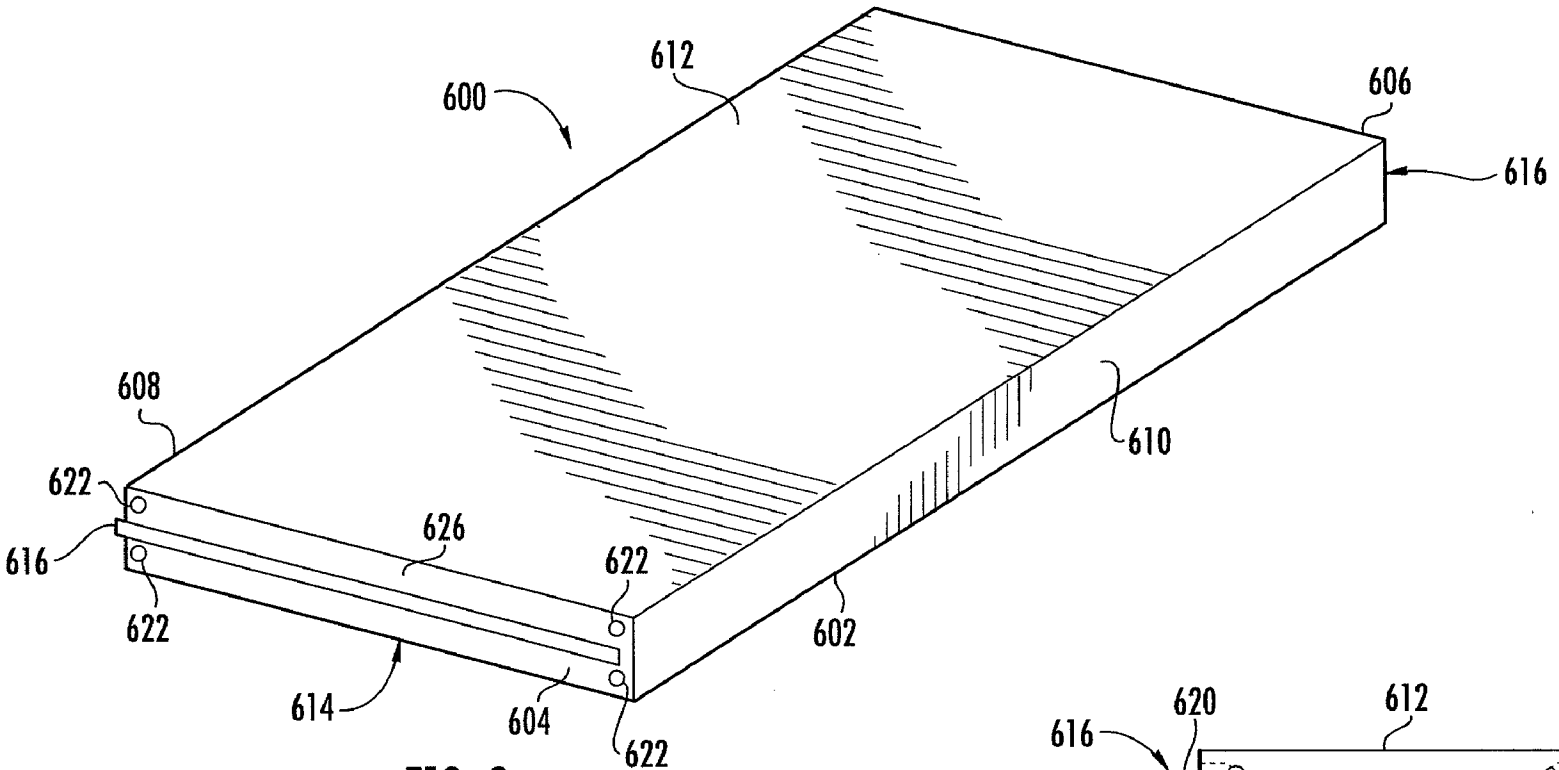

FIG. 8 illustrates a perspective view of a light shelf according to one embodiment of the invention.

Figure 9:
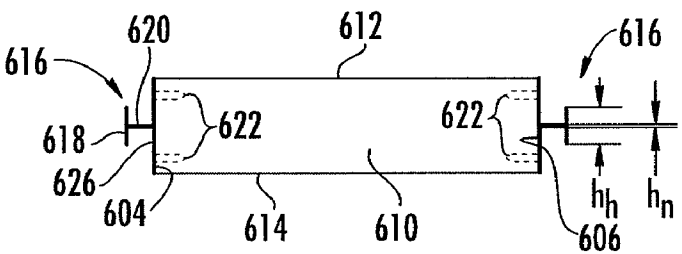

FIG. 9 illustrates an end view of the light shelf shown in FIG. 8.

Figures 10, 11:
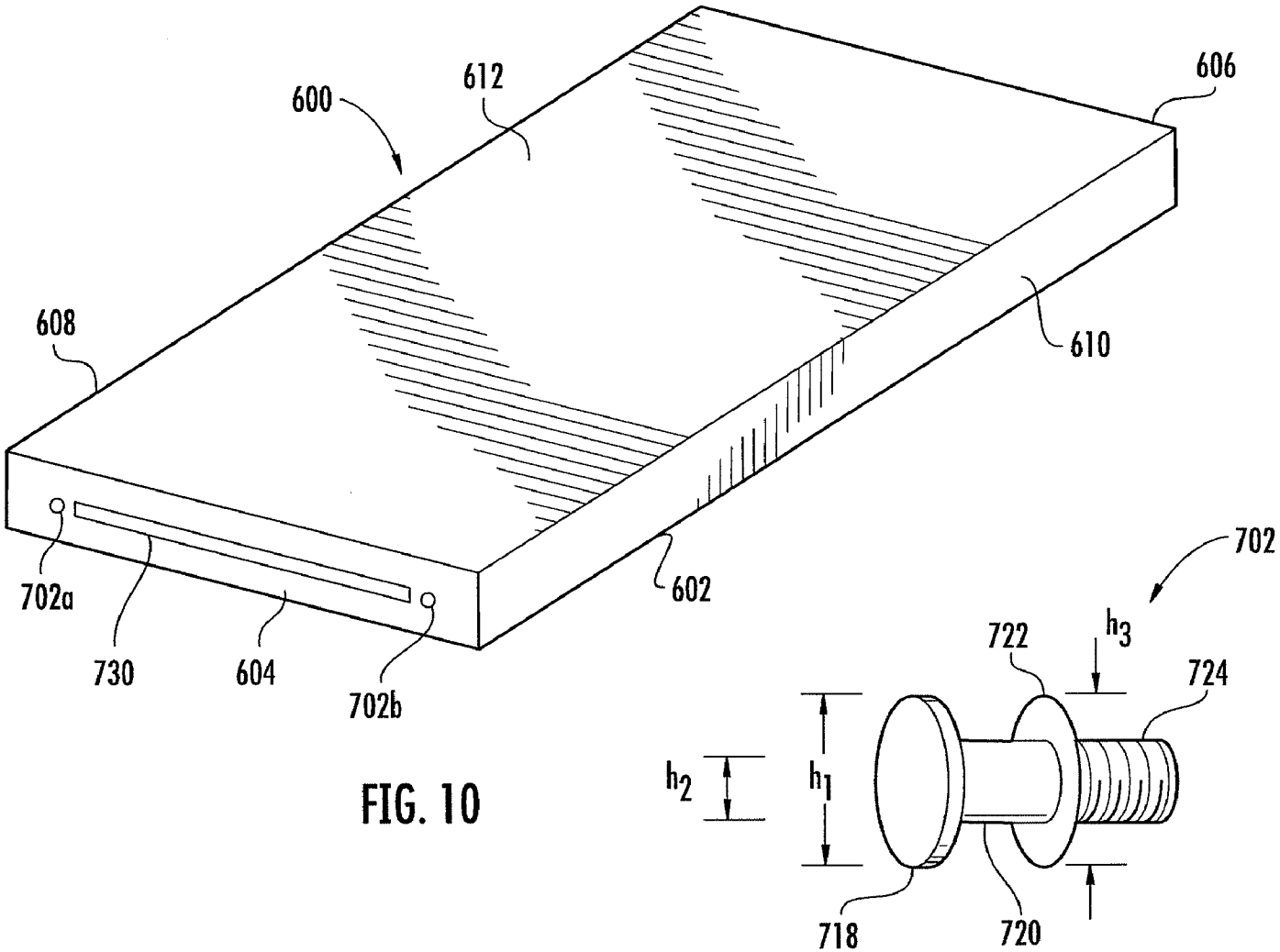

FIG. 10 illustrates a perspective view of a light shelf according to another embodiment of the invention.

FIG. 11 illustrates a perspective view of a pin according to one embodiment of the invention.

Figure 12:
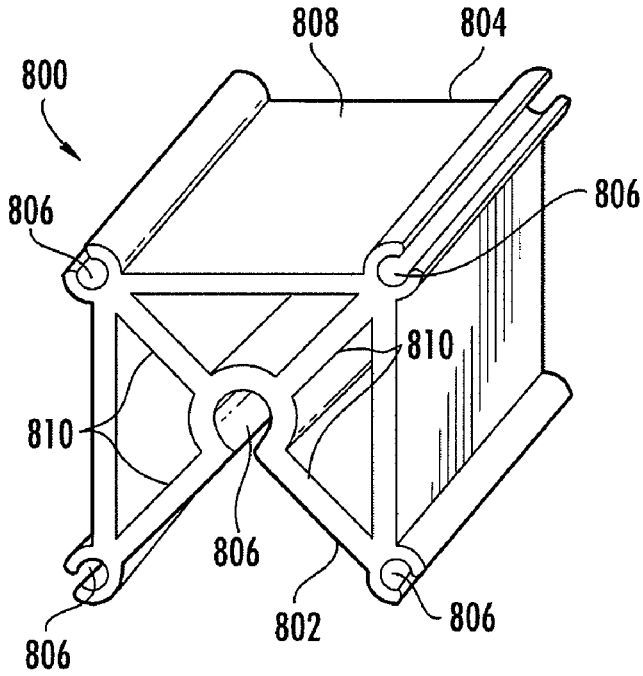

FIG. 12 illustrates a shear block according to one embodiment of the invention.

Figure 13:
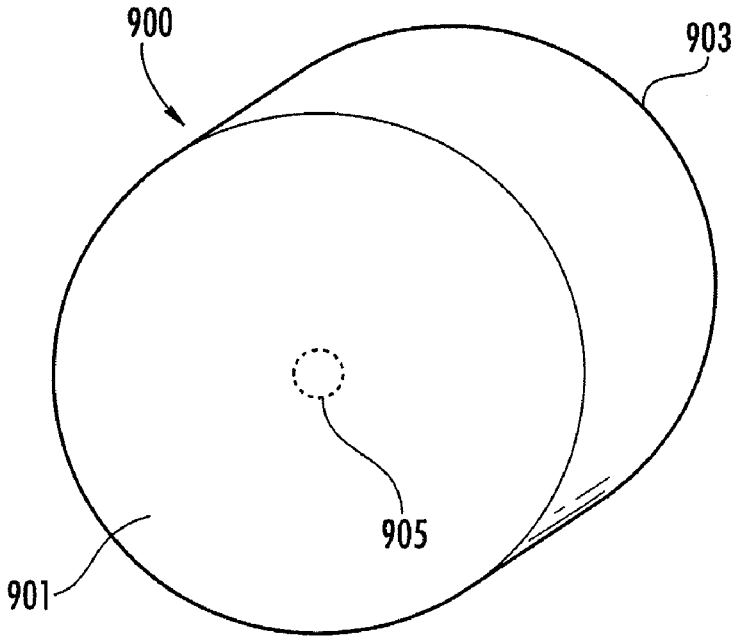

FIG. 13 illustrates a perspective view of an end cover according to one embodiment of the invention.

Figure 14:
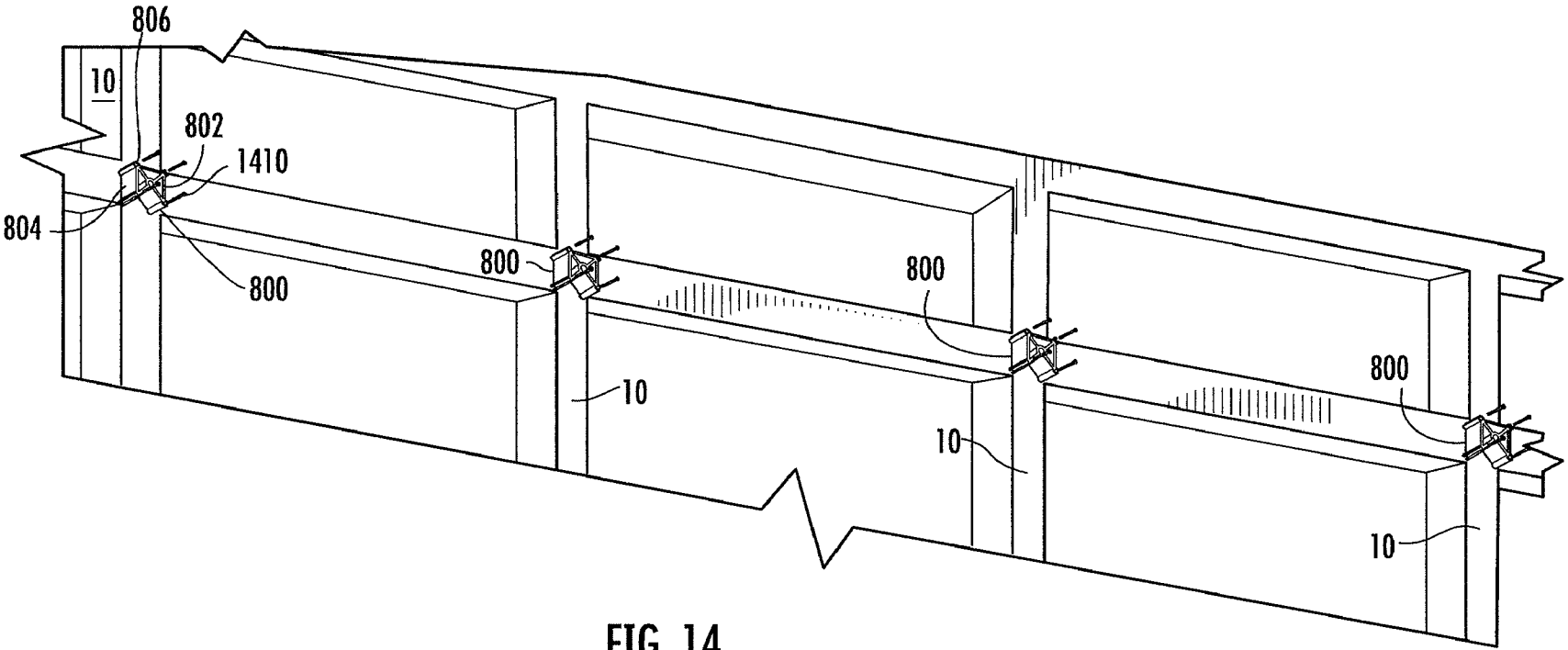
Figure 15:
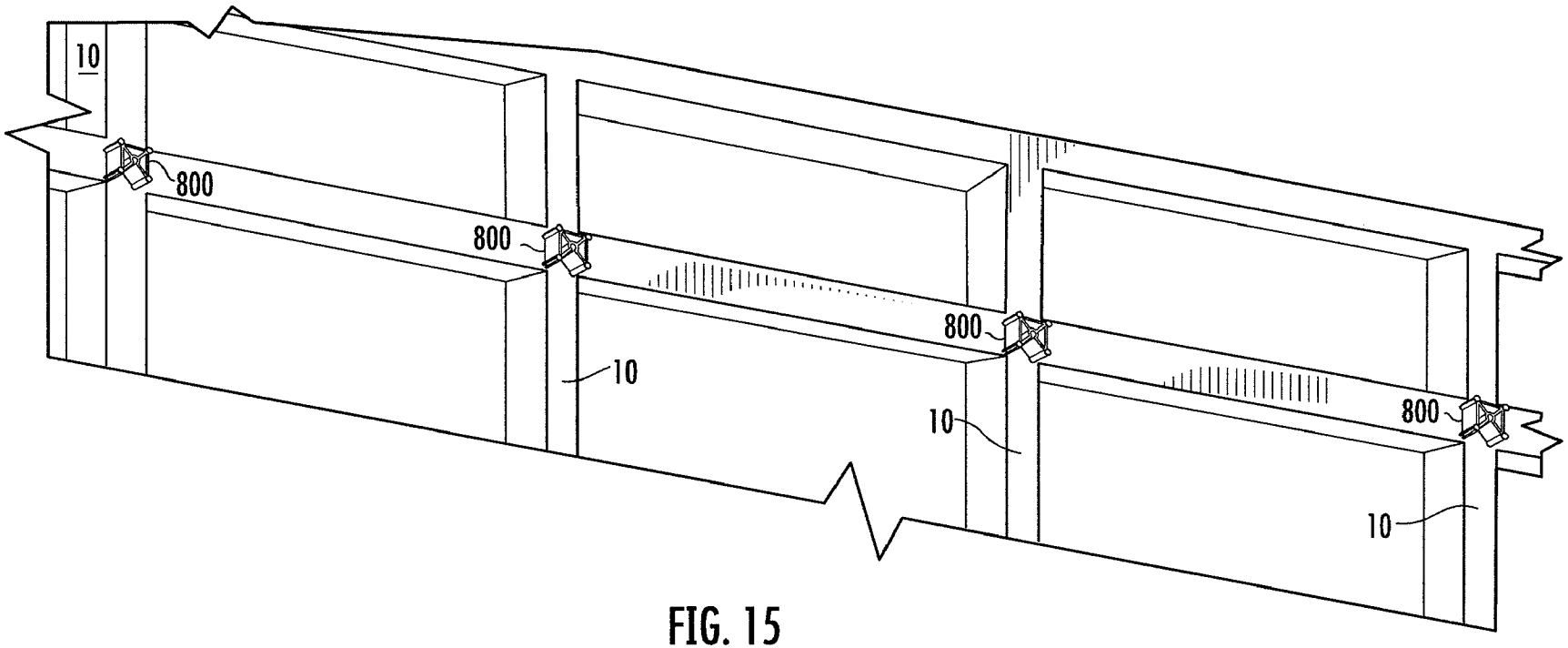

FIGS. 14 and 15 illustrate perspective views of a plurality of the shear block shown in FIG. 12 being installed adjacent vertical mullions according to one embodiment of the invention.

Figure 16:
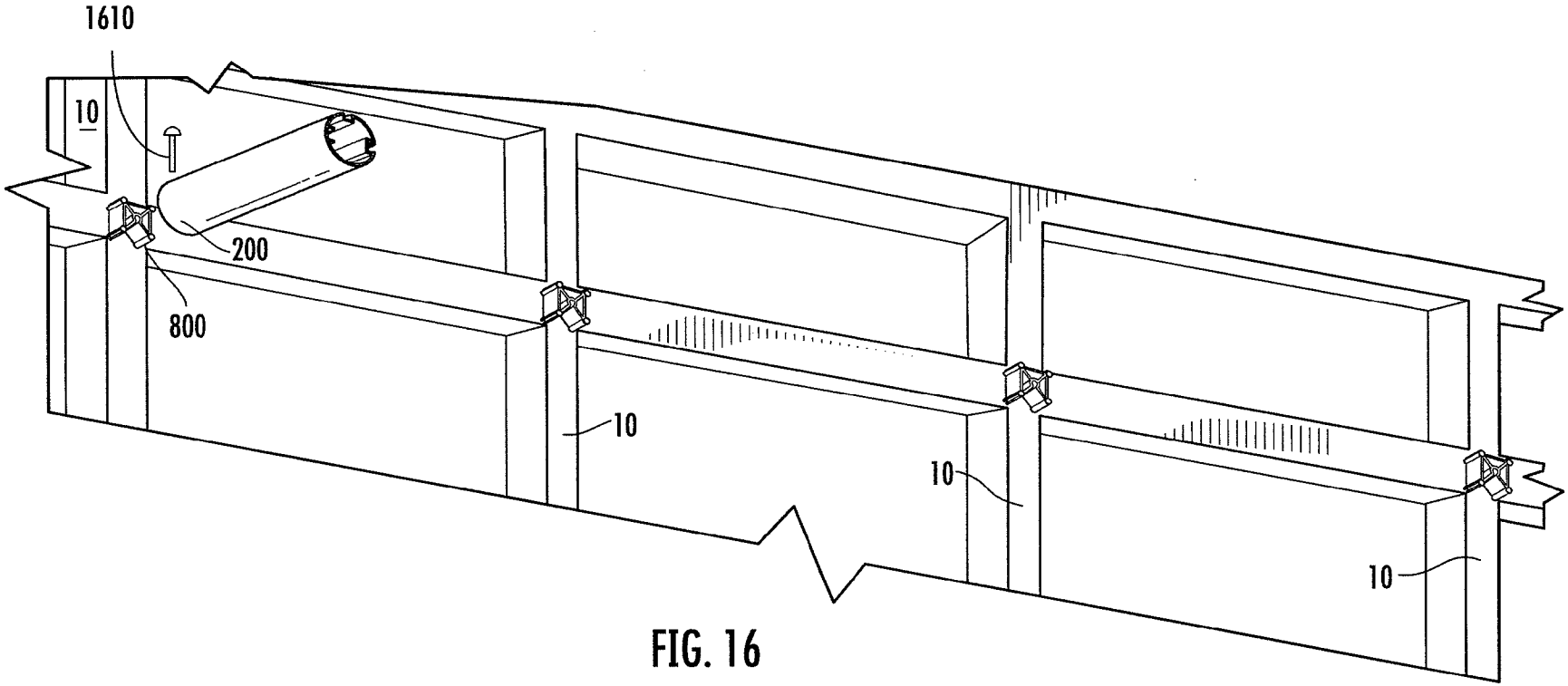
Figure 17:
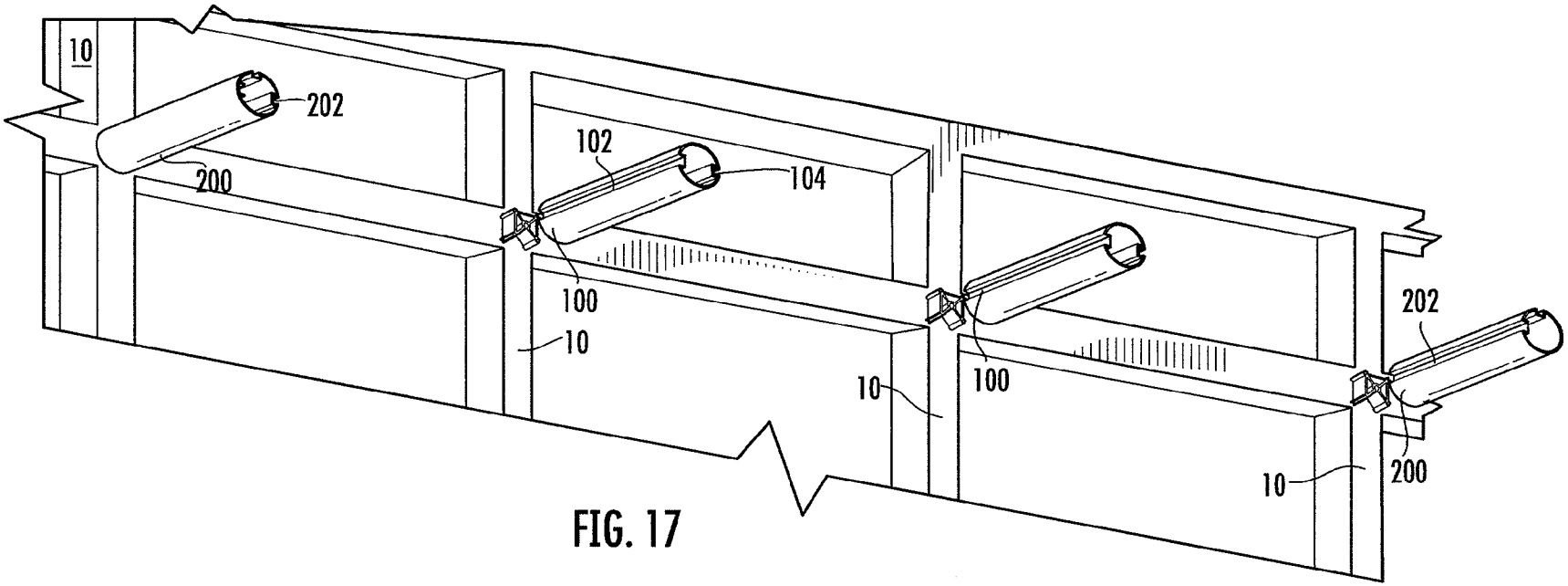

FIGS. 16 and 17 illustrate perspective views of a plurality of the support arms shown in FIG. 1 through 4 being installed adjacent the shear blocks shown in FIGS. 14 and 15 according to one embodiment of the invention.

Figure 18:
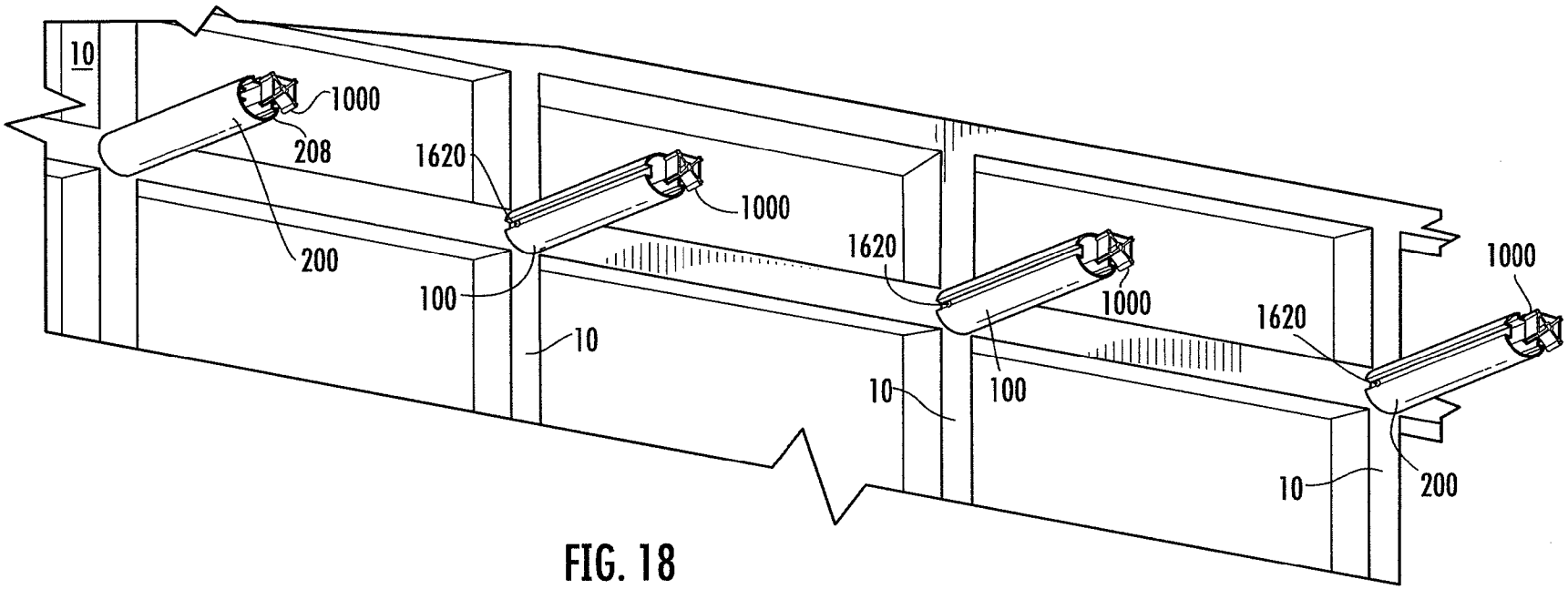

FIG. 18 illustrates a perspective view of a plurality of cover support members being installed adjacent a second end of each of the support arms shown in FIGS. 16 and 17 according to one embodiment of the invention.

Figure 19:
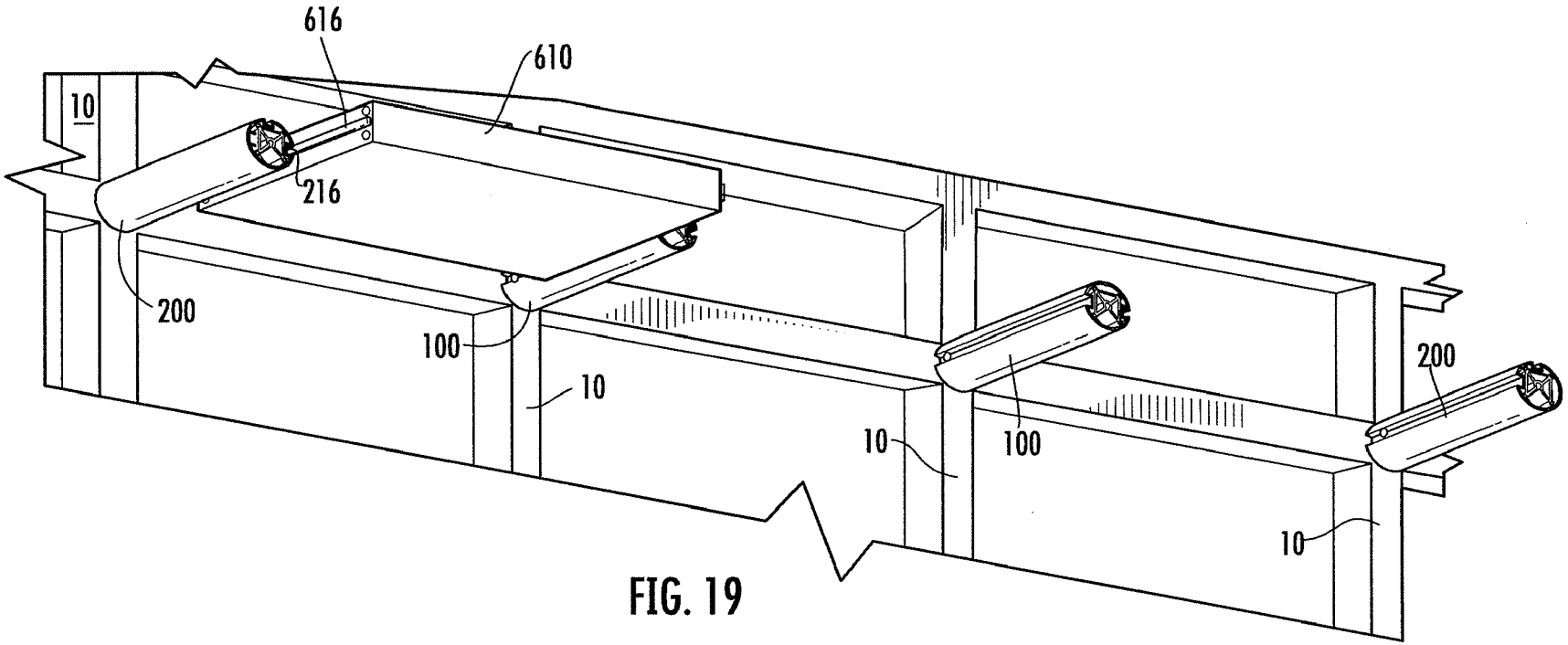
Figure 20:
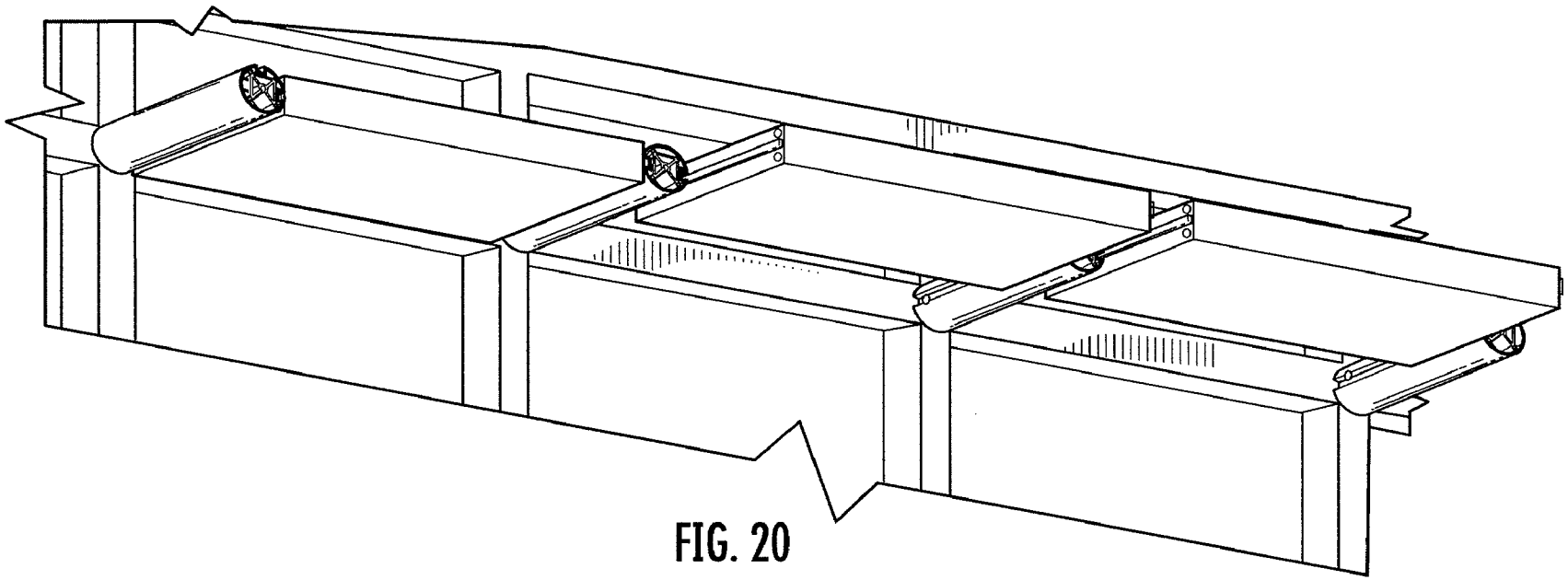

FIGS. 19 and 20 illustrate perspective views of a plurality of the light shelves shown in FIGS. 9 and 10 being installed between the support arms shown in FIGS. 16 through 18 according to one embodiment of the invention.

Figure 21:
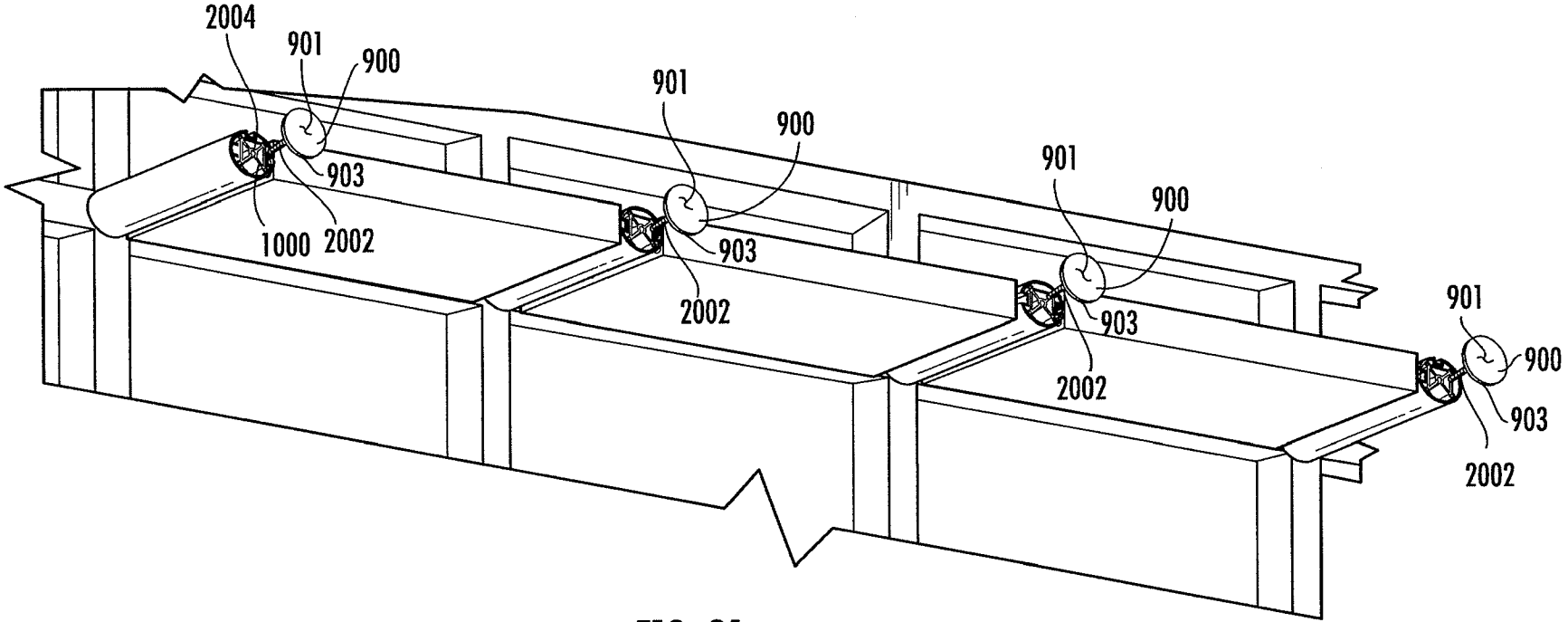

FIG. 21 illustrates a perspective view of a plurality of the end cover shown in FIG. 13 being installed adjacent the second end of each support arms shown in FIGS. 16 through 20 according to one embodiment of the invention.

Figure 22:
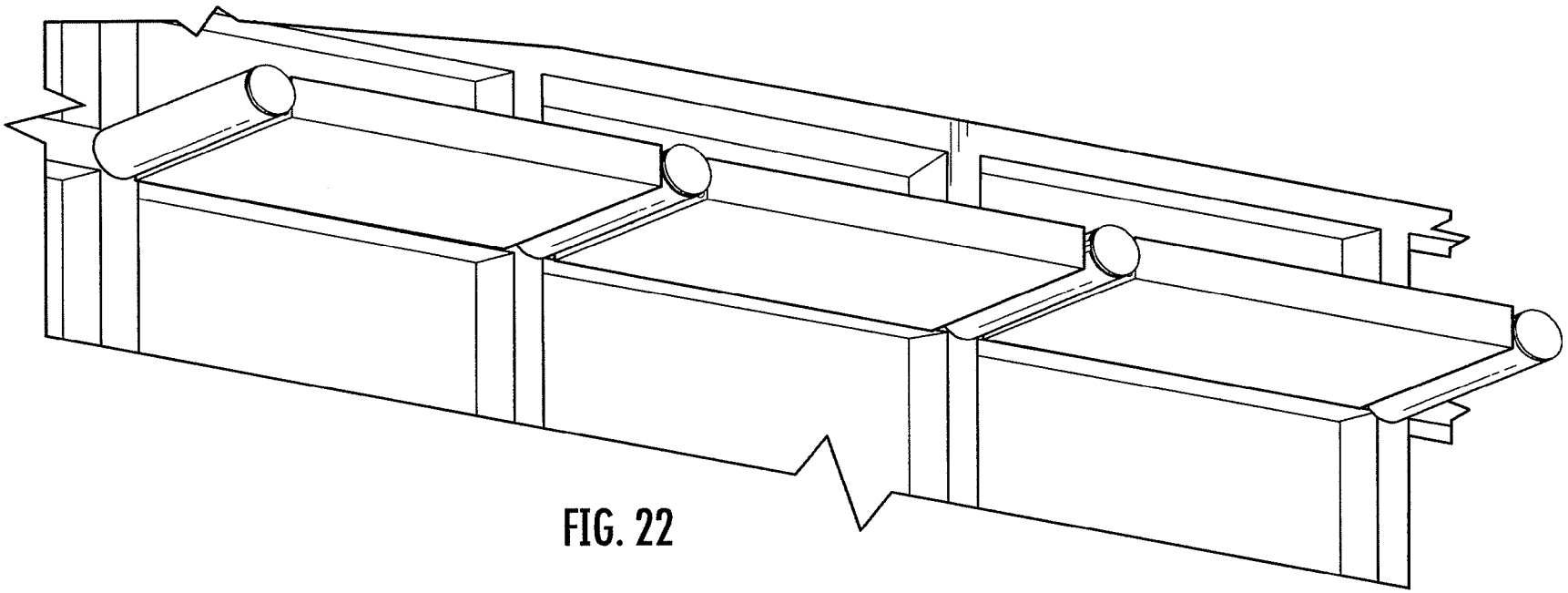

FIG. 22 illustrates a perspective view of a completed installation according to the embodiments shown in FIGS. 14 through 21.

Figure 23:
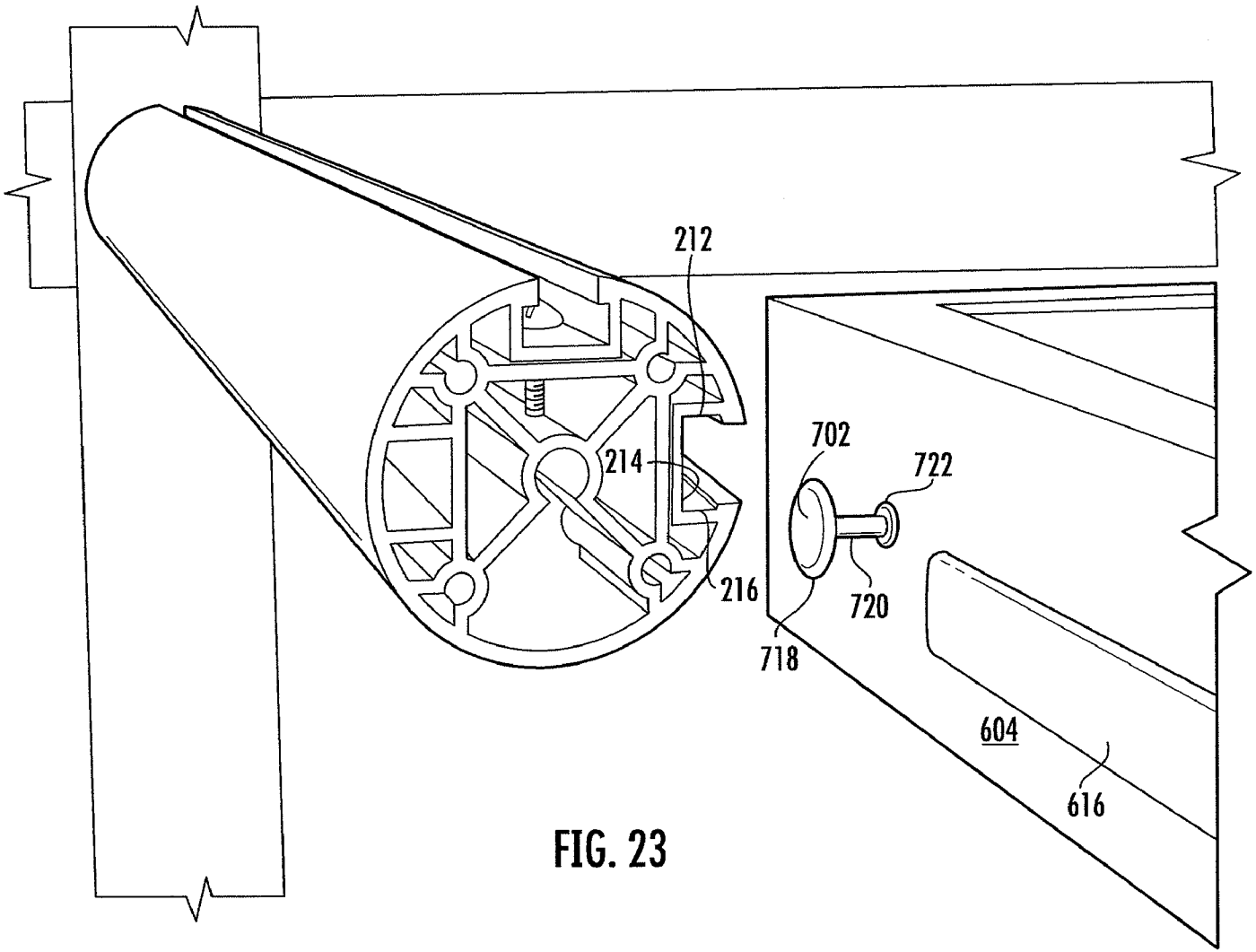
Figure 26:
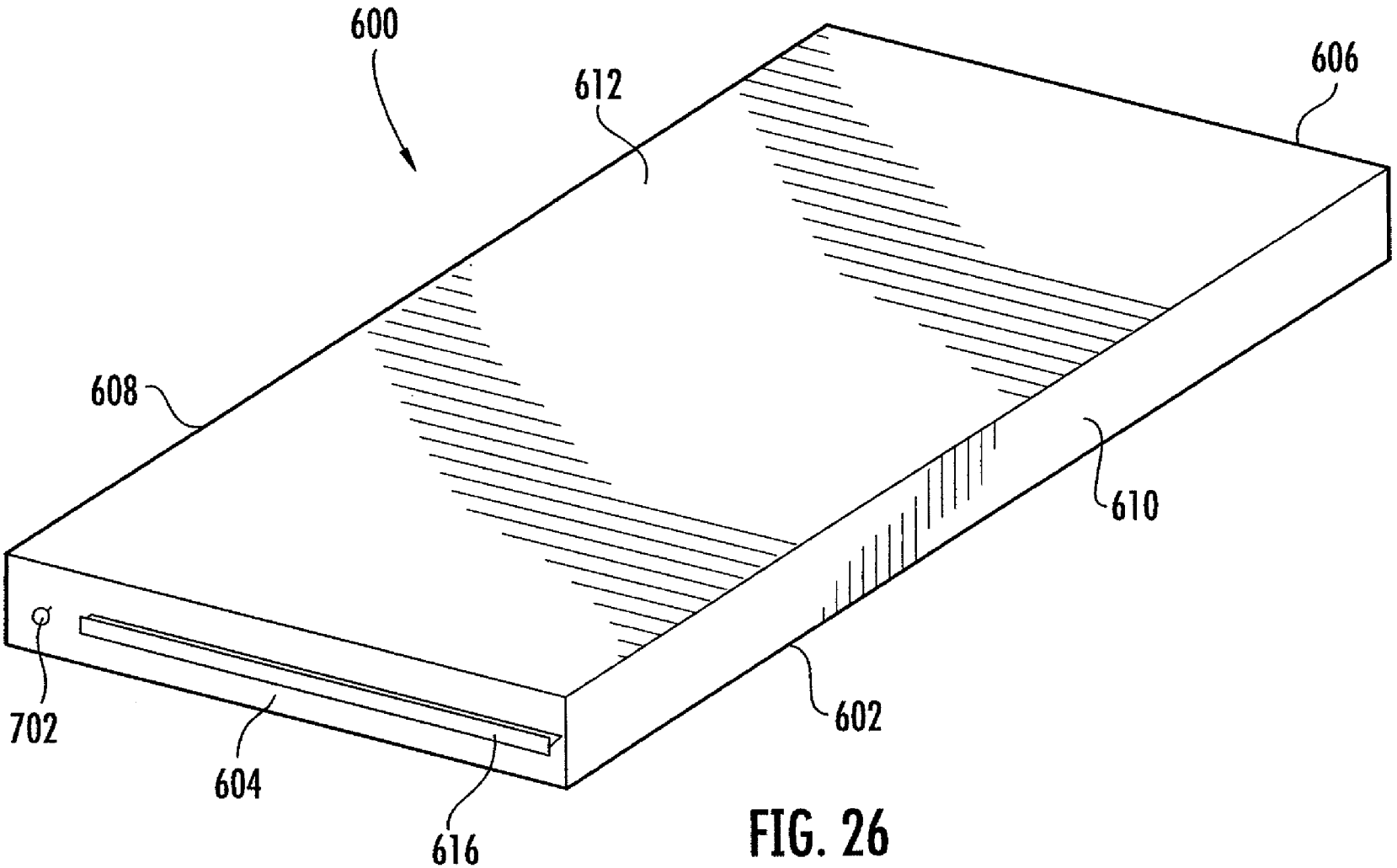

FIG. 23 illustrates a perspective view of the installation of the light shelf shown in FIG. 26 adjacent the support arm shown in FIG. 4 according to one embodiment.

Figure 24:
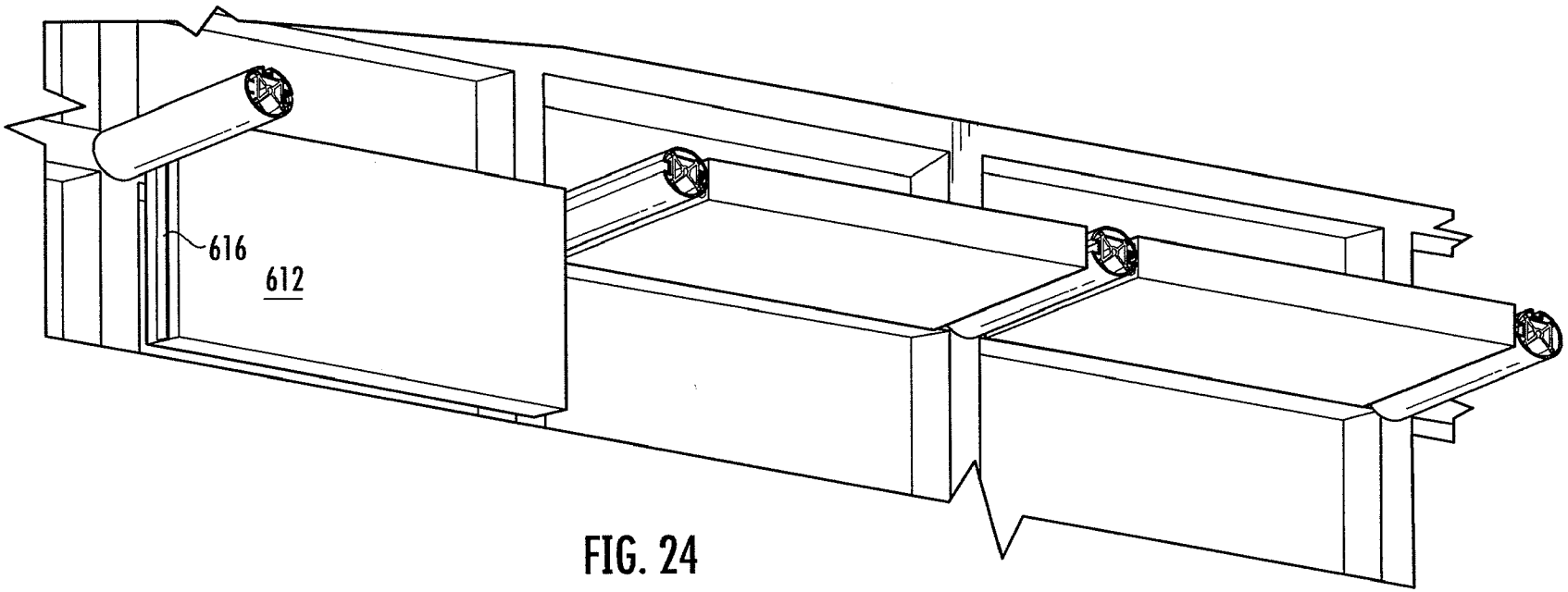

FIG. 24 illustrates a perspective view of the light shelf shown in FIG. 23 pivoted downwardly about the pins according to one embodiment.

Figure 25:
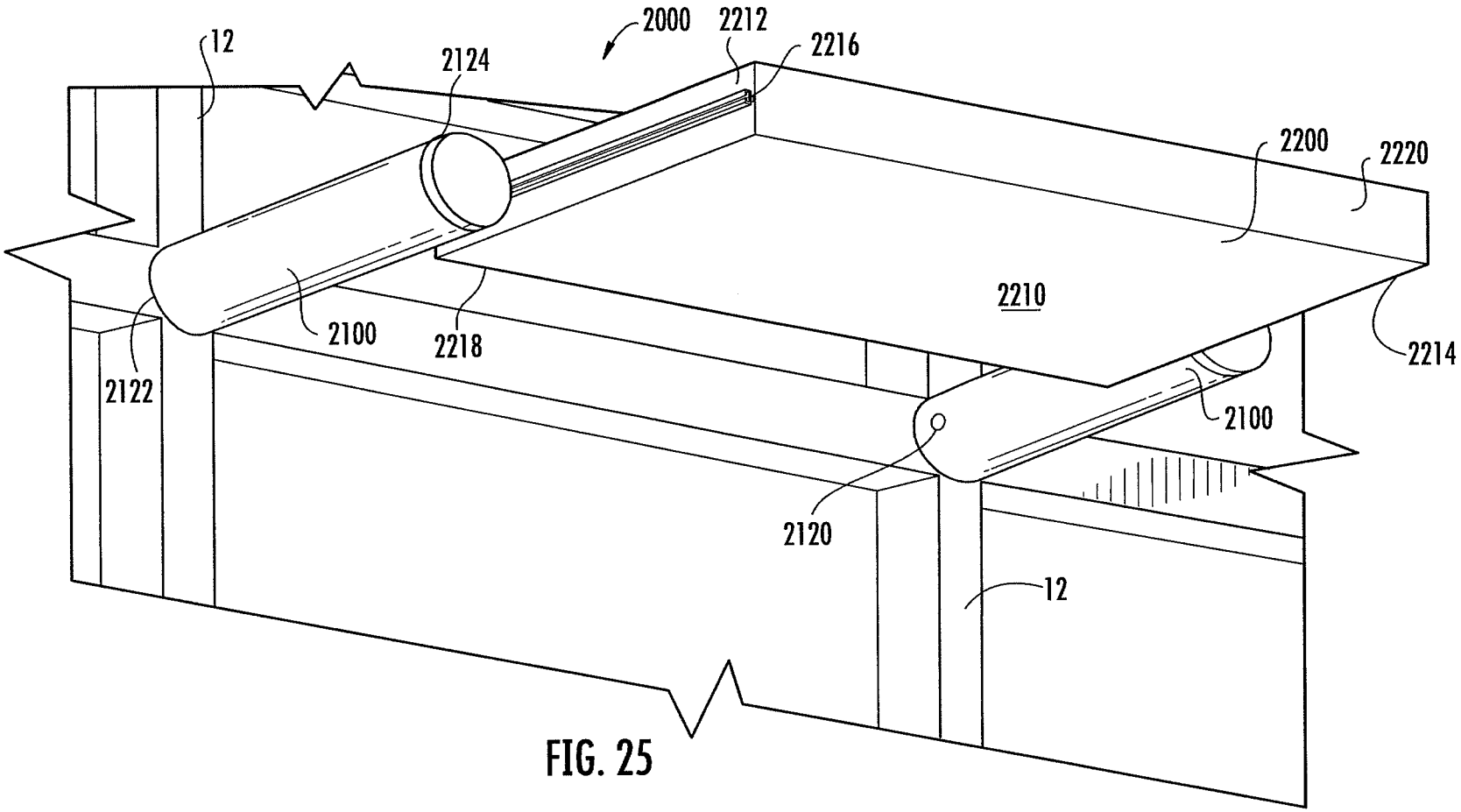

FIG. 25 illustrates a light shelf assembly according to an alternative embodiment of the invention.

FIG. 26 illustrates a perspective view of a light shelf according to another embodiment of the invention.

DETAILED DESCRIPTION OF VARIOUS EMBODIMENTS OF THE INVENTION

Various embodiments of the present invention now will be described more fully hereinafter with reference to the accompanying drawings, in which some, but not all embodiments of the inventions are shown. These inventions may be embodied in many different forms and should not be construed as limited to the embodiments set forth herein. Rather, these embodiments are provided so that this disclosure will satisfy applicable legal requirements. Like numbers refer to like elements throughout.

Various embodiments provide a modular light shelf assembly in which individual light shelf units are substantially prefabricated, which requires significantly less labor for installing the light shelves at the construction site. For example, in various embodiments, the assembly includes prefabricated support arms that are secured adjacent an interior wall of a building adjacent a window opening. Each of the support arms define at least one channel, and each light shelf includes at least one protrusion extending from each of a first side and a second side of the light shelf. The protrusion on the first side of the light shelf slidably engages the channel of the support arm adjacent the first side of the light shelf, and the protrusion on the second side of the light shelf slidably engages the channel on the support arm adjacent the second side of the light shelf to secure the light shelf between the adjacent support arms.

In certain embodiments, the support arms are elongated, hollow outer members that are attached adjacent the interior wall by sliding a first end of each arm over a shear block that has been secured to the interior wall. The support arm, according to particular embodiments, may be secured to the shear block by engaging at least one fastener through the support arm. In addition, in certain embodiments, the protrusion may have a head portion at a distal end of the protrusion and a neck portion that extends between the head portion and a side surface of the light shelf. The neck portion has a height that is less than a height of the head portion, and the length of the neck portion is sufficient to allow for a slight variation in the spacing of the support arms. Each channel defined along the outer surface of the support arms defines an opening that has a height that is greater than the height of the neck portion to allow the protrusion to slide within the opening of the channel but less than the height of the head portion to prevent the head portion from passing through the opening in a radially outward direction. In addition, the interior portion of each channel has a height that is greater than the head portion of each protrusion to allow the head portion to slide within the interior portion of the channel.

In one embodiment, the protrusion includes a mushroom-shaped pin extending from each side surface of the light shelf adjacent a back edge surface of the light shelf, which is the edge of the light shelf that is adjacent the interior wall of the building when the light shelf is installed between adjacent support arms, and an elongated rail that extends along the length of each side surface and is disposed between the mushroom-shaped pin and a front edge surface of the light shelf. In another embodiment, the protrusion includes at least two mushroom-shaped pins extending from each side of the light shelf. The mushroom-shaped pins of these embodiments slidably engage the channels on the support arms to secure the light shelf between adjacent support arms. However, in these embodiments, the light shelf may be rotated about the set of mushroom-shaped pins disposed adjacent the back edge surface of the light shelf by slidably disengaging the elongated rail or the other mushroom-shaped pins such that the set of pins disposed adjacent the back edge surface remain engaged in the channels of the arms. This embodiment facilitates access to the upper surface of the light shelf for cleaning or other purposes. In yet another embodiment, the protrusion includes an elongated rail. In addition, the various embodiments described above result in relatively quick and efficient installation of light shelves, which reduces installation time and costs.

Each of the sections below describes various embodiments of the support arms, the shear blocks, the light shelves and protrusions that extend from the light shelves, and methods of assembling the light shelves relative to the interior wall of the building.

Support Arms

According to various embodiments, each of the two or more support arms has a first end and a second end, and the first end is secured to the interior wall and the second end extends away from the interior wall. In addition, each support arm defines at least one channel along an outer surface of the support arm, and at least a portion of the channel extends substantially parallel to the longitudinal axis of the support arm.

For example, FIGS. 1 through 3 illustrate one embodiment of the support arm. In particular, the support arm 100 defines two channels 102, 104 that extend along the outer surface 106 of the support arm 100, and the two channels 102, 104 are spaced apart substantially 180°. The channels 102, 104 extend between the second end 108 of the support arm 100 and the first end 110 of the support arm 100.

In the embodiments shown in FIGS. 1 through 3, the channels 102, 104 extend radially inwardly of the outer surface 106 of the support arm 100. Each channel 102, 104 comprises a retaining slot 112 that defines an opening along the outer surface 106 of the support arm 100 and an interior portion 114 that is radially inward of the retaining slot 112. A height of the opening defined by the retaining slot 112 is less than a height of the interior portion 114. Each of the channels 102, 104 further define a second opening 116 at the second end 108 of the support arm 100 that is in communication with the retaining slot 112 and interior portion 114 of the respective channel 102, 104. The second opening 116 has substantially the same shape as the cross sectional shape of the respective channel 102, 104 as taken through a plane that is substantially normal to the longitudinal axis of the support arm 100.

According to another embodiment, which is shown in FIG. 4, the support arm 200 defines two channels 202, 230 that extend along the outer surface 206 of the support arm 200 and are disposed along longitudinal axes that are substantially parallel but are spaced apart at an angle of about 90° from each other. As discussed in more detail below in relation to the embodiments shown in FIG. 14 through 24, support arms 200 may be secured to the interior wall at each end of the area spanned by the light shelf installation, and the support arms 100 may be secured to the interior wall in an intermediate portion of the installation area (i.e., disposed between the support arms 200).

According to various other embodiments, such as shown in FIG. 5, the channels 302, 304 extend radially outwardly of the outer surface 306 of the support arm 300. Each channel 302, 304 comprises a retaining slot 312 that defines an elongated opening and an interior portion 314 that is radially inward of the retaining slot 312. Like the embodiment described above in relation to FIGS. 1 through 3, a height of the opening defined by the retaining slot 312 is less than a height of the interior portion 314. Each of the channels 302, 304 further define a second opening 316 at the second end 308 of the support arm 300 that is in communication with the retaining slot 312 and interior portion 314 of the respective channel 302, 304. The second opening 316 has substantially the same shape as the cross sectional shape of the respective channel 302, 304 as taken through a plane that is substantially normal to the longitudinal axis of the support arm 300.

The support arms 100, 200, 300 described above in relation to FIGS. 1 through 5 define an inner surface 120, 220, 320, respectively. According to various embodiments, a reinforcement member is slidably disposed within the hollow, elongated outer support arm 100, 200, 300 and engages at least a portion of the inner surface 120, 220, 320. For example, an end view of a particular embodiment of the reinforcement member 400 is shown in FIG. 6. The reinforcement member 400 according to one embodiment is an elongated member that extends substantially the length of the support arm 100, 200, 300. However, in various other embodiments, the reinforcement member 400 has a length that is less than the length of the support arm 100, 200, 300. In one such embodiment, a first reinforcement member 400 is slidably disposed adjacent at least the second end 108, 208, 308 of the support arm 100, 200, 300, and one or more additional reinforcement members 400 are slidably disposed adjacent an intermediate portion of the support arm 100, 200, 300 between the first end and second end.

According to various embodiments, the reinforcement member 400 defines at least one elongated channel that extends from at least one end of the reinforcement member. In the particular embodiment shown in FIG. 6, the reinforcement member 400 defines a plurality of channels 402 that extend the length of the reinforcement member 400. As discussed below in relation to FIGS. 14 through 24, these channels 402 may be engaged with threaded fasteners or pins to secure the reinforcement member 400 to the interior wall of the building or to secure an end cover to the second end 108, 208, 308 of the support arm 100, 200, 300.

In the embodiments shown in FIGS. 1 through 5, the support arms 100, 200, 300 have a substantially cylindrical shape. However, in various other embodiments (not shown), the support arm may have a cross section having a non-circular shape, such as a substantially triangular, substantially rectangular, or other polygonal cross-sectional shape.

In addition, in the embodiment shown in FIGS. 1 through 5, the support arms 100, 200, 300 are shown as being hollow, elongated members. However, in various other embodiments (not shown), the support arms may be solid or partially hollow. For example, the support arm may define a hollow portion adjacent the first end and/or the second end of the support arm and be solid or honeycombed elsewhere.

Furthermore, as discussed below in relation to FIGS. 16 and 17, the embodiments described above in relation to FIGS. 1 through 5 may be secured adjacent the interior wall via a shear block, which is slidably engaged into the first end of the support arm 100, 200, 300. In one such embodiment, the support arm 100, 200, 300 further defines an aperture through an upper or lower surface of the support arm 100, 200, 300 through which a fastener or pin may be engaged to secure the support arm 100, 200, 300 relative to the shear block.

However, in various other embodiments, the support arm may be secured adjacent the interior wall directly using one or more fasteners. For example, in the embodiment shown in FIG. 7, tabs 522 are integrally formed with the first end 510, and the tabs 522 extend within the interior portion 514 of the channels 502, 504 and each define an aperture 524 therethrough. A fastener or pin may be engaged through each aperture 524 to secure the support arm 500 adjacent the interior wall. In other various embodiments (not shown), the support arm may define upper and/or lower channels, and a tab integrally formed with the first end of the support arm extends within the interior portion of the upper and/or lower channels. In yet another embodiment (not shown), the one or more tabs (or bosses) may be disposed outside of channels defined in the support arm and, instead, extend radially outwardly from the outer surface of the support arm.

Finally, the embodiment of the support arm 200 described above in relation to FIG. 4 defines channel 230 that is disposed about 90° from the channel 202 and extends the length of the support arm 200. However, in various other embodiments, the channel 230 may be disposed at an angle different than 90° from the channel 202 and/or may not extend the length of the support arm 200. In addition, according to various other embodiments, the support arm 200 may not include channel 230 and may instead include only channel 202. In one such embodiment, the support arm 200 may define a groove or slot in its outer surface 206 instead of channel 230.

According to yet another embodiment (not shown), the support arm defines a first slot and a second slot disposed on at least one side of the support arm. The first slot, which is disposed closer to the first end of the support arm, has a substantially L-shape as viewed from the side of the support arm, wherein a substantially vertical portion of the first slot extends from a portion of the support arm adjacent an upper surface of the support arm downwardly toward the side surface of the support arm, and a substantially horizontal portion of the first slot extends from the vertical portion toward the first end of the support arm along the side surface of the support arm. The second slot, which is disposed closer to the second end of the support arm, may have a similar shape or it may be substantially horizontal and extend along the side surface of the support arm from the second end of the support arm toward the first slot.

According to various embodiments, the support arm and the reinforcement member are manufactured by extrusion molding, injection molding, die casting, or other suitable method of manufacturing, and the material from which the support arm and reinforcement member are formed may include, for example, metal (e.g., aluminum, steel, titanium), plastic resin, glass fiber, or a combination thereof.

Light Shelf

Various embodiments of the light shelf assembly include one or more light shelves that are each slidably disposed between adjacent support arms. According to various embodiments, each light shelf includes a substantially planar base portion that has a first side surface and a second side surface, and the first side surface is opposite and spaced apart from the second side surface. The light shelf further includes at least one protrusion that extends outwardly from each of the first and second side surfaces. The protrusions slidably engage the channel of the support arm disposed adjacent to each side surface of the light shelf such that a back edge surface of the base portion is disposed adjacent the first ends of the support arms, a front edge surface of the base portion is disposed adjacent the second ends of the support arms, and the light shelf is suspended between the support arms. In various embodiments, the protrusion is an elongated rail, and in various other embodiments, the protrusion is a pin.

FIG. 8 illustrates a light shelf according to one embodiment. The light shelf 600 includes a substantially planar base portion 602 that includes first side surface 604 and second side surface 606, which are spaced apart from and opposite each other, and a back edge surface 608 and a front edge surface 610 that extend between the first and second side surfaces 604, 606 and are spaced apart from and opposite each other. The base portion 602 further includes an upper surface 612 and a lower surface 614. As discussed below in relation to FIGS. 19, 20, 23, and 24, the light shelf 600 is slidably disposed between adjacent support arms such that the back edge surface 608 is adjacent the first ends of the support arms, the front edge surface 610 is adjacent the second ends of the support arms, the upper surface 612 faces the ceiling of the room, and the lower surface 614 faces the floor of the room.

Extending from each of the first and second side surface 604, 606 is an elongated rail 616. The rail 616 has a substantially T-shaped cross section as taken through a plane extending substantially normal to the longitudinal axis of the rail 616. In particular, as shown in FIG. 9, the rail 616 includes a head portion 618 and a neck portion 620. The head portion 618 is disposed at a distal end of the rail 616, and the neck portion 620 is extends between the head portion 618 and the side surface 604, 606 of the base portion 602. The neck portion 620 has a height $h_n$ that is less than a height $h_h$ of the head portion 618.

In the embodiment shown in FIGS. 8 and 9, the rail 616 further includes a plate 626 adjacent the proximate end of the neck portion 620, and the plate 626 defines apertures therethrough for receiving fasteners 622 to secure the plate 626 to the side surfaces 604, 606. The rail 616 is integrally formed with the plate 626 according to the embodiment shown in FIGS. 8 and 9, but in other various embodiments, the rail may be separately formed and attachable to the plate, for example, using an adhesive, a snap fit arrangement, or other suitable fastening means. In other embodiments, the rail may be integrally formed with the side surfaces 604, 606, or secured adjacent the side surfaces 604, 606 using adhesive, a snap fit arrangement, or other suitable fastening means.

Although the embodiment of the rail shown in FIGS. 8 and 9 is described as having a T or H-shaped cross sectional shape, the rail according to other various embodiments (not shown) may have substantially the same height along the width of the rail (i.e., between the distal end of the rail and the side surface of the base portion).

In various other embodiments, the protrusion is a pin that extends from each side surface 604, 606 of the light shelf 600. For example, in the embodiment shown in FIG. 10, two pins 702 are secured to each side surface 604, 606. A first pin 702*a* is secured to the side surface 604 adjacent the back edge surface 608 of the base portion 602, and the second pin 702*b* is secured to the side surface 604 adjacent the front edge surface 610. Although not shown in FIG. 10, another set of pins are secured to the side surface 606 in a similar manner. According to the embodiment shown in FIG. 11, each pin 702 includes a head portion 718, a neck portion 720, an annular flange 722, and a threaded fastener portion 724. The head portion 718 is disposed at a first end of the pin 702, and the threaded fastener portion 724 extends axially along a portion of the length of the pin 702 from a second end of the pin toward the first end of the pin 702, wherein the first end of the pin 702 and the second end of the pin 702 are axially opposite each other and spaced apart. The annular flange 722 is disposed axially inwardly from the second end of the pin 702 between the threaded fastener portion 724 and the neck portion 720 and extends radially outwardly from the longitudinal axis of the pin 702. The neck portion 720 extends between from the head portion 718 and the annular flange 722.

In addition, the head portion 718 has a height $h_1$ that is greater than a height $h_2$ of the neck portion 720, and the annular flange 724 has a height $h_3$ that is greater than the height $h_2$ of the neck portion 720. To secure the pin 702 adjacent the side surface 604, 606 of the base portion 602, the threaded fastener portion 724 is engaged into an aperture defined in the side surface 604, 606 such that the annular flange 722 is disposed adjacent the side surface 604, 606.

In various embodiments, each side surface 604, 606 further includes a fin 730 that extends outwardly from and along each side surface 604, 606 and is disposed between the pins 702*a*, 702*b*. In one embodiment, the fin 730 has a width (as measured from its proximate end adjacent each side surface 604, 606 to its distal end which is spaced apart from each side surface 604, 606) that is less than a width of each pin 702*a*, 702*b* (as measured from the annular flange 722 to the head portion 718 of each pin 702*a*, 702*b*). In such an embodiment, the fin 730 does not engage the channel of an adjacent support arm when installed between adjacent support arms, but the distal end of the fin 730 is disposed sufficiently close to the adjacent support arm to substantially prevent light from passing between the fin 730 and the adjacent support arm. In other various embodiments (not shown), the fin may have a width that is substantially the same or greater than the width of each pin 702*a*, 702*b* such that the fin engages the channel of the adjacent support arm and substantially prevents light from passing between the fin and the adjacent support arm.

In other various embodiments, such as the embodiments shown in FIG. 26, the protrusion includes a pin, such as pin 702 described above, that extends from each side surface 604, 606 of the light shelf 600 adjacent the back edge surface 608 and an elongated rail, such as the elongated rail 616 described above, that extends substantially between the front edge surface 610 and the pin 702.

Although the embodiment of the pin shown in FIGS. 10, 11, and 26 is described as being secured adjacent the side surfaces 604, 606 using a threaded fastener portion, the pin may be secured using other suitable means, such as a friction fit, snap fit, adhesive, or integrally molded with a framing member that is secured to the side surface 604, 606 of the base portion 602. For example, in one particular alternative embodiment (not shown), an elongated framing member may be provided, such as the plate 624 described above in relation to FIG. 8, and the pins may be integrally formed or otherwise attached to the framing member. In addition, although the embodiments described above have a substantially T or H-shaped cross sectional shape, the pins according to other various embodiments (not shown) may have substantially the same height along the width of the pins (i.e., between the distal end of the pin and the side surface of the base portion).

According to the embodiments shown in FIGS. 8, 10, and 26, the back edge surface, the front edge surface, and the side surfaces of the light shelf have a substantially rectangular shaped cross section. However, in other embodiments (not shown), these surfaces of the light shelf may have a substantially arcuate shape, a substantially semicircular shape, a triangular shape, a trapezoidal shape, and/or other suitable shape.

According to various embodiments, the light shelves are manufactured using relatively light weight materials. For example, in one embodiment, the base portion is manufactured from a composite of melamine and fiberboard, and a reflective coating or material is disposed on the upper surface. Extruded aluminum framing members, such as plate 624 describe above in relation to FIG. 8, are then disposed adjacent the side surfaces, the front edge surface, and the back edge surface. In other various embodiments, other suitable light weight materials may be used for manufacturing the base potion (such as, for example, polymer-based materials (e.g., polystyrene foam), wood, and/or hollow or thin aluminum panels) and the framing members (such as, for example, polymer-based materials, wood, and/or other light weight metals (e.g., titanium)).

Furthermore, the pins and elongated rails described above may be manufactured using any suitable material that provides sufficient strength and resiliency to secure the light shelf between the support arms. For example, in one embodiment, the pins and elongated rails may be made from stainless steel, aluminum, or the same material as the framing member to which the pins and/or elongated rails are attached.

In various embodiment, the framing member are secured to the base portion using fasteners that extend through the framing members and the base portion, such as fasteners 622 for securing plate 624 to the base portion as described above in relation to FIG. 8, but in other various embodiments, the framing members may be secured adjacent the side surfaces, the front edge surface, and/or the back edge surface using a snap fit arrangement, adhesive, or other suitable fastening means.

Shear Block

As mentioned above in relation to FIGS. 1 through 5, according to various embodiments, the support arm is secured adjacent the interior wall via a shear block. FIG. 12 illustrates a shear block 800 according to one embodiment. The shear block 800 includes a first end 802, a second end 804, and one or more apertures 806 extending between the first end 802 and the second end 804. A fastener, such as a threaded fastener or pin, is inserted through the apertures 806 from the first end 802 toward the second end 804 to secure the shear block 800 to the interior wall. When the shear block 800 is secured to the interior wall, the second end 804 is adjacent the interior wall, and the first end 802 is spaced apart and cantilevered outwardly from the interior wall.

In the embodiment of the shear block 800 shown in FIG. 12, the outer perimeter 808 of the block 800 has a substantially rectangular cross-sectional shape, and apertures 806 are disposed adjacent each corner of the outer perimeter 808. In addition, the inner support surfaces 810 of the block 800 form a substantially X-shaped cross-section and define another aperture 806 substantially at the center of the block 800. According to one embodiment, this structure is lightweight and provides sufficient strength for supporting the support arm and the light shelf cantilevered relative to the interior wall. However, various embodiments may include shear blocks having other shaped cross-sections. For example, in various embodiments (not shown), the shear block may have a cross-sectional shape substantially similar to the reinforcement member 400 shown in FIG. 6. In particular, according to one such embodiment, the shear block may be formed by cutting off a certain length of the reinforcement member 400.

End Cover and Cover Support Member

Various embodiments include an end cover that is secured adjacent the second end of the support arm to prevent the light shelf from slidably disengaging the channel of the support arm and/or to provide an aesthetic finish to the light shelf assembly. One embodiment of the end cover 900 is shown in FIG. 13. The end cover 900 has a first surface 901 and a second surface 903, and the second surface 903 is secured adjacent the second end of the support arm. In a particular embodiment, the second surface 903 also defines an aperture substantially adjacent its center for receiving a threaded fastener that extends axially from the center of the second end of the support arm. However, in various other embodiments, the end cover 900 can be secured be other suitable means, such as one or more pins that extend between the end cover and the second end of the support arm, a friction fit or snap fit adjacent to the second end of the support arm, or adhesive. In addition, as described below in relation to FIG. 21, the end cover may be secured adjacent the second end of the support arm via a cover support member.

According to various embodiments, each support arm includes a cover support member that is disposed adjacent the second end of the support arm. The cover support member secures the end cover adjacent the second end of the support arm. In one embodiment, the cover support member has a cross-sectional shape substantially similar to the cross-sectional shape of the shear block 800 shown in FIG. 12, and in another embodiment, the cross-sectional shape of the cover support member has a shape substantially similar to the cross-sectional shape of the reinforcement member 400 shown in FIG. 6. However, in other various embodiments, the cover support member has other cross-sectional shapes that sufficiently engage at least a portion of the inner surface of the support arm adjacent the second end of the support arm.

The cover support member according to various embodiments is separately formed from the support arm and is slidably disposed adjacent the inner surface and second end of the support arm. A cover support member 1000 according to one such embodiment is shown in FIG. 21. However, in other embodiments, the cover support member is integrally formed with the support arm. And, in yet another embodiment, the cover support member is part of a reinforcement member that extends axially through the support arm, such as the reinforcement member 400 shown in FIG. 6.

Method of Assembling the Light Shelf Assembly

According to various embodiments, the light shelf assembly is assembled by providing at least two support arms, such as the support arms described above in relation to FIGS. 1 through 5, and at least one light shelf, such as the light shelf described above in relation to FIGS. 8 through 11 and 26. Next, the first ends of the support arms are secured to an interior wall of a building such that the support arms are spaced apart substantially horizontally along the interior wall of the building, and an opening defined by the channel is within a substantially horizontal plane that extends between two adjacent support arms. Then, the protrusion extending from the first side surface of the base portion is slidably disposed in the channel of the support arm adjacent the first side surface, and the protrusion extending from the second side surface is slidably disposed in the channel of the support arm adjacent the second side surface such that the back edge surface of the base portion is disposed adjacent the first ends of the support arms, the front edge surface of the base portion is disposed adjacent the second ends of the support arms, and the light shelf is suspended between the support arms.

FIGS. 14 through 25 illustrate various steps of the assembly process according to certain embodiments. In particular, FIGS. 14 and 15 illustrate the process of installing the shear blocks 800 described above in relation to FIG. 12 to the interior surface of vertical mullions 10 according to one embodiment. As shown in FIG. 14, one or more fasteners 1410, such as a threaded fastener or pin, is inserted through the apertures 806 from the first end 802 toward the second end 804 to secure the shear block 800 to the vertical mullion 10. When the shear block 800 is secured to the interior wall, the second end 804 is adjacent the vertical mullion 10, and the first end 802 is spaced apart and cantilevered outwardly from the vertical mullion 10. FIG. 15 shows several shear blocks 800 installed on horizontally spaced apart vertical mullions 10.

FIGS. 16 and 17 show the installation of the support arms 100, 200 described above in relation to FIGS. 1 through 4 being secured adjacent the shear blocks 800 shown in FIGS. 14 and 15 according to one embodiment. In the embodiment shown in FIGS. 16 and 17, support arms 200 are installed at each end of the light shelf assembly, and support arms 100 are installed between the ends of the light shelf assembly. To secure the support arms 100, 200 adjacent to the vertical mullion 10, the first end 110, 210 of the support arms 100, 200 is slidably engaged over the outer surface 808 of the shear block 800. At least a portion of the outer surface 808 of the shear block 800 engages the inner surface 120, 220 of the support arms 100, 200. The support arms 100, 200 are oriented such that the channels 102, 104, 202 defined in the outer surface 106, 206 of the support arms 100, 200 are disposed in a substantially horizontal plane that extends between adjacent support arms 100, 200, the channel 202 defined in each of the support arms 200 substantially faces the adjacent support arm 100, and the channel 230 defined in each of the support arms 200 substantially faces the ceiling of the interior room (i.e., in a substantially upward direction). However, in various other embodiments, the support arm 200 may be installed such that the channel 230 substantially faces the floor of the interior room (i.e., in a substantially downward direction). In addition, it should be understood that in various alternative embodiments, support arms according to other embodiments, or support arms that all have the same structure, may be used in the assembly.

In various embodiments, at least one elongated fastener, such as a threaded fastener or pin, may be engaged through an outer surface 106, 206 of the support arm 100, 200 and into the shear block 800. For example, as shown in FIG. 16, a threaded fastener 1610 is engaged through each of the upper surface of each of support arm 100 and through an aperture 1620 defined in at least one of the channels 102, 104 of the support arm 100. In addition, a threaded fastener 1610 is engaged through each of the upper channel 230 of support arm 200 and the aperture 1620 defined in the channel 202 in support arm 200. In a particular embodiment (not shown), the upper surface of the support arm 100 may define a channel, groove, or slot through which the fastener 1610 is engaged.

Next, as shown in FIG. 18, a cover support member 1000 is slidably disposed adjacent the inner surface 120, 220 and the second end 108, 208 of each support arm 100, 200. In one embodiment, the cover support member 1000 is prevented from moving axially relative to the second end 108, 208 by engaging at least one elongated fastener 1010, such as a threaded fastener or pin, through the outer surface 106, 206 of the support arm and the cover support member 1000. In the embodiment shown in FIG. 18, the elongated fastener 1010 is engaged through the upper surface of each support arm 100, 200. In a particular embodiment, the upper surface of the support arm 100, 200 may define a channel, groove, or slot through which the aperture extends. As noted above, the cover support member 1000 shown in FIG. 18 has a cross sectional shape similar to the shear block 800 described above in relation to FIG. 12. However, in various other embodiments, the cover support member 1000 may have other cross-sectional shapes.

Then, as shown in FIGS. 19 and 20, light shelves are installed between the support arms 100, 200 according to one embodiment. In the embodiment shown in FIGS. 19 and 20, light shelves 600 according to the embodiment described above in relation to FIGS. 8 and 9 are shown. Accordingly, in this embodiment, the elongated rails 616 on each side surface 604, 606 are each slidably disposed within channel 102, 104, 202 of support arm 100, 200 such that the back edge surface 608 is disposed adjacent the vertical mullion 10 and the front edge surface 610 is disposed adjacent the first end 110, 210 of the support arm 100, 200. To slidably engage the rail 616 in the channel 102, 104, 202, the end of the rail 616 adjacent the back edge surface 608 is engaged through the second opening 116, 216 at the second end 108, 208 of the support arm 100, 200 such that the head portion 618 is disposed in the interior portion 114, 214 of the channel 102, 104, 202 and the neck portion 620 is disposed between the retaining slot 112, 212 of the channel 102, 104, 202.

Finally, after the light shelves 600 are slidably disposed between the support arms 100, 200, the covers are secured to the second ends 108, 208 of the support arms 100, 200 according to one embodiment. In the embodiment shown in FIG. 21, the covers used are covers 900 shown in FIG. 13. As shown in FIG. 21, a first end of a threaded fastener 2002 is engaged in aperture 905 of the cover 900, and a second end of the threaded fastener 2002 is engaged into an aperture 2004 of the cover support member 1000. In the embodiment shown in FIG. 20, the aperture 905 is disposed at substantially the center of the second surface 903 of the cover 900, and the aperture 2004 of the cover support member 1000 is disposed at substantially the center of the second end 108, 208 of the support arm 100, 200. FIG. 22 illustrates a fully assembled light shelf assembly according to the embodiments described above in relation to FIGS. 14 through 21.

According to another embodiment, which is illustrated in FIGS. 23 and 24, the light shelf assembly is assembled using elements similar to those described above in relation to FIGS. 14 through 18 and 21, but the embodiment of the light shelf 600 slidably disposed between the support arms 100, 200 is the embodiment shown in FIGS. 11 and 26. In particular, the head portion 718 of pin 702, which is disposed on the side surfaces 604, 606 of the base portion 602 adjacent the back edge surface 608, is slidably engaged into the second opening 116, 216 of the channel 102, 104, 202 of the support arm 100, 200 and along the interior portion 114, 214 of the channel 102, 104, 202. The neck portion 720 of each pin 702*a*, 702*b* is disposed between the retaining slot 112, 212. Then, the end of the rail 616 adjacent the pin 702 is engaged through the second opening 116, 216 at the second end 108, 208 of the support arm 100, 200 such that the head portion 618 is disposed in the interior portion 114, 214 of the channel 102, 104, 202 and the neck portion 620 is disposed between the retaining slot 112, 212 of the channel 102, 104, 202. The light shelf 600 is slidably urged toward the interior wall until the back edge surface 608 is adjacent the interior wall and the front edge surface 610 is adjacent the second end 108, 208 of adjacent support arms 100, 200.

As shown in FIG. 24, the light shelf 600 according to the embodiment shown in FIG. 23 can be pivoted downwardly (or upwardly) about the pins 702 by slidably disengaging the rails 616 from the channels 102, 104, 202. In particular, the light shelf 600 is slidably urged away from the interior wall until the rails 616 are disengaged from the channels 102, 104, 204, and the light shelf 600 is rotated about pins 702, which continue to be engaged in the channels 102, 104, 204. This ability to pivot the light shelf 600 downwardly allows access to the upper surface 612 without having to remove the light shelf 600 from the support arms 100, 200.

Although not shown, the embodiment of the light shelf shown in FIG. 10 can be installed between adjacent support arms 100, 200 similarly by engaging pins 702*a*, 702*b* through the second opening 116, 216 at the second end 108, 208 of the support arm 100, 200 such that the head portion 718 is disposed in the interior portion 114, 214 of the channel 102, 104, 202 and the neck portion 720 is disposed between the retaining slot 112, 212 of the channel 102, 104, 202. To pivot the light shelf 600 about pins 702*a*, pins 702*b* are disengaged from the channel.

FIG. 25 illustrates a light shelf assembly 2000 according to an alternative embodiment of the invention. In particular, the light shelf assembly 2000 includes: (1) two or more support arms 2100 spaced apart substantially horizontally along an interior wall 12 of a building and (2) at least one light shelf 2200 that includes a substantially planar base portion 2210 having a first side surface 2212 and second side surface 2214, which are opposite and spaced apart from each other. Each of the two or more support arms 2100 define at least one protrusion 2120 that extends radially outwardly from an outer surface of the support arm 2100, and each protrusion 2120 is substantially within a horizontal plane that extends between two adjacent support arms 2100. In addition, each support arm 2100 has a first end 2122 and a second end 2124. The first end 2122 is secured to the interior wall, and the second end 2124 is spaced apart from the interior wall 12. In addition, each side surface 2212, 2214 of the base portion 2210 defines at least one channel 2216 that extends along a length of the side surface 2212, 2214, and each of the channels 2216 define an opening. The at least one protrusion 2120 extending from the support arm 2100 adjacent the first side surface 2212 is slidably engaged into the opening defined by the at least one channel 2216 defined on the first side surface 2212, and the at least one protrusion 2120 extending from the support arm 2100 adjacent the second side surface 2214 is slidably engaged into the opening of the at least one channel 2216 defined on the second side surface 2214 such that a back edge surface 2218 of the base portion 2210 is disposed adjacent the first ends 2122 of the support arms 2100, a front edge surface 2220 of the base portion 2210 is disposed adjacent the second ends 2124 of the support arms 2100, and the light shelf 2200 is suspended between the support arms 2100.

Conclusion

Although various embodiments of the invention have been described in specific detail with reference to the disclosed embodiments, it will be understood that many variations and modifications may be effected within the spirit and scope of the invention as described in the appended claims.

The invention claimed is:

1. A light shelf assembly comprising:

two or more support arms spaced apart substantially horizontally along an interior wall of a building, each support arm having a first end and a second end, the first end being secured to the interior wall and the second end extending away from the interior wall and being spaced apart from the interior wall, and each support arm defining at least one channel along an outer surface of the support arm; and at least one light shelf comprising a substantially planar base portion, the base portion having a reflective upper surface, a first side surface and a second side surface, the first side surface being opposite and spaced apart from the second side surface, the at least one light shelf further comprising at least one protrusion that extends outwardly from each of the first and second side surfaces, wherein the at least one protrusion comprises at least a first pivot member and a second portion for each of the first and second side surfaces and wherein a gap is formed between the at least first pivot member and the second portion, wherein:

the channel defines an opening that is at least partially within a horizontal plane that extends between two adjacent support arms, the at least one protrusion extending from the first side surface slidably engages the channel of the support arm adjacent the first side surface and the at least one protrusion extending from the second side surface slidably engages the channel of the support arm adjacent the second side surface such that a back edge surface of the base portion is disposed adjacent the first ends of the support arms, a front edge surface of the base portion is disposed adjacent the second ends of the support arms, and the light shelf is suspended between the support arms, and the light shelf is pivotable about the first pivot members when the second portions of the at least one protrusion for each of the first and second side surfaces are slidably disengaged from the channels of the adjacent support arms.

2. The light shelf assembly of claim 1, wherein the first pivot members comprise first pins and the second portions comprise second pins extending from each of the first side surface and the second side surface, the first pins being disposed adjacent the back edge surface of the base portion and the second pins being disposed adjacent the front edge surface of the base portion.

3. The light shelf assembly of claim 2, wherein the light shelf is pivotable about the first pins when the second pins are slidably disengaged from the channels of the adjacent support arms.

4. The light shelf assembly of claim 2 wherein the second portions each further comprise a fin that extends outwardly from each side surface of the light shelf and is disposed between the first pin and the second pin.

5. The light shelf assembly of claim 1, wherein:

the channel defines a retaining slot, the retaining slot having an opening along the surface of the support arm having a first height and an interior portion radially inward of the opening that has a second height, the first height being less than the second height, the first pivot member comprises a first pin having a neck portion and a head portion, the head portion being at a distal end of the first pin, the neck portion extending between the head portion and a proximate end of the first pin, and the neck portion having a third height and the head portion having a fourth height, and the third height of the neck portion being less than the fourth height of the head portion and the first height of the opening of the retaining slot, and the fourth height of the head portion being less than the second height of the interior portion of the retaining slot and greater than the first height of the opening of the retaining slot.

6. The light shelf assembly of claim 5, wherein the opening in the retaining slot is a first opening and the retaining slot further includes a second opening at the second end of the support arm that is in communication with the first opening, the second opening having a fifth height that is substantially the same as the second height of the interior portion of the retaining slot.

7. The light shelf assembly of claim 6 further comprising an end cover, the end cover being disposed adjacent the second end of the support arm to substantially cover the second opening.

8. The light shelf assembly of claim 1, wherein the second portion of the at least one protrusion comprises an elongated rail.

9. The light shelf assembly of claim 1, wherein the at least one channel along the outer surface of the support arm has a depth that extends inwardly from the outer surface of the support arm and a length that extends substantially parallel to a longitudinal axis of the support arm from the second end toward the first end.

10. The light shelf assembly of claim 1, wherein the at least one channel along the outer surface of the support arm defines a track that extends outwardly from the outer surface of the support arm, the track having a length that extends substantially parallel to a longitudinal axis of the support arm from the second end toward the first end.

11. The light shelf assembly of claim 1, wherein the channel defines a retaining slot, the retaining slot having an opening along the surface of the support arm having a first height and an interior portion radially inward of the opening that has a second height, the first height being less than the second height.

12. The light shelf assembly of claim 1, wherein at least one of the two or more support arms defines a first channel on a first side of the support arm and a second channel on a second side of the support arm, wherein the first channel and second channel are spaced about 180° degrees apart.

13. The light shelf assembly of claim 1, wherein at least one of the two or more support arms defines a first channel on a first side of the support arm and a second channel on a second side of the support arm, wherein the first channel and second channel are spaced about 90° degrees apart.

14. The light shelf assembly of claim 1, wherein each support arm is substantially cylindrical.

15. The light shelf assembly of claim 1, wherein each support arm is substantially rectangular.

16. The light shelf assembly of claim 1, wherein each support arm comprises an elongated, hollow outer shell that defines the at least one channel and an elongated reinforcement member that is slidably disposed within the hollow outer shell.

17. The light shelf assembly of claim 16, wherein the reinforcement member includes a first end that is configured for engaging at least a distal end of a shear block secured to the interior wall to secure the reinforcement member to the interior wall, and a second end of the reinforcement member comprises a cover attachment portion for securing a cover adjacent the reinforcement member.

18. The light shelf assembly of claim 1, wherein each support arm comprises an elongated, hollow outer shell that defines the at least one channel, and the light shelf assembly further comprises two or more shear blocks, a proximate end of each shear block being secured to the interior wall, and a distal end of each shear block extending outwardly from the interior wall, the first end of each support arm shaped to slidably receive the distal end of the shear block.

19. The light shelf assembly of claim 18 wherein the shear blocks are secured to the interior wall by engaging at least one threaded fastener from the distal end through the proximate end of each shear block and into the interior wall.

20. The light shelf assembly of claim 18 wherein each support arm defines an aperture extending through an upper surface of the support arm adjacent the first end of the support arm, the aperture being aligned with an aperture defined in an upper surface of the shear block by slidably engaging the first end of the support arm over the shear block, and the apertures are configured for receiving a fastener therethrough.

21. The light shelf assembly of claim 18 wherein each support arm defines an aperture extending through a lower surface of the support arm adjacent the first end of the support arm, the aperture being aligned with an aperture defined in a lower surface of the shear block by slidably engaging the first end of the support arm over the shear block, and the apertures are configured for receiving a fastener therethrough.

22. The light shelf assembly of claim 1 wherein each support arm comprises a cover support member adjacent the second end of the support arm, wherein the cover support member defines a threaded fastener that extends axially from an end of the cover support member, and the assembly further comprises a cover defining a threaded aperture extending from one side of the cover, the cover being secured to the cover support member by engaging the threaded fastener into the threaded aperture of the cover.

23. The light shelf assembly of claim 22 wherein the cover support member is integrally formed with the support arm.

24. The light shelf assembly of claim 22 wherein the cover support member is separately formed from the support arm, the support arm comprises a hollow, elongated outer member, and the cover support member is slidably disposed within the second end of the hollow, elongated outer member.

25. The light shelf assembly of claim 1 wherein each support arm comprises a cover support member adjacent the second end of the support arm, wherein the cover support member defines a threaded aperture that extends axially from an end of the cover support member, and the assembly further comprises a cover defining a threaded fastener that extends axially from one side of the cover, the cover being secured to the cover support member by engaging the threaded fastener into the threaded aperture of the cover support member.

26. The light shelf assembly of claim 25 wherein the cover support member is integrally formed with the support arm.

27. The light shelf assembly of claim 25 wherein the cover support member is separately formed from the support arm, the support arm comprises a hollow, elongated outer member, and the cover support member is slidably disposed within the second end of the hollow, elongated outer member.

28. The light assembly of claim 1, wherein the pivot members comprise:

a first pin extending from the first side surface and a second pin extending from the second side surface, each of the first pin and the second pin being disposed adjacent the back edge surface of the base portion, and wherein the second portions comprise a first elongated rail extending along the first side surface and a second elongated rail extending along the second side surface, the first elongated rail being disposed between the first pin and the front edge surface of the base portion and the second elongated rail being disposed between the second pin and the front edge surface of the base portion.

29. A light shelf assembly comprising:

two or more support arms spaced apart substantially horizontally along an interior wall of a building, each support arm having a first end and a second end, the first end being secured to the interior wall and the second end extending away from the interior wall and being spaced apart from the interior wall, and each support arm defining at least one channel along an outer surface of the support arm; and at least one light shelf comprising a substantially planar base portion, the base portion having a first side surface and a second side surface, the first side surface being opposite and spaced apart from the second side surface, the at least one light shelf further comprising at least one protrusion that extends outwardly from each of the first and second side surfaces, wherein:

the channel defines an opening that is at least partially within a horizontal plane that extends between two adjacent support arms, the at least one protrusion extending from the first side surface slidably engages the channel of the support arm adjacent the first side surface and the at least one protrusion extending from the second side surface slidably engages the channel of the support arm adjacent the second side surface such that a back edge surface of the base portion is disposed adjacent the first ends of the support arms, a front edge surface of the base portion is disposed adjacent the second ends of the support arms, and the light shelf is suspended between the support arms, and wherein:

the two or more support arms comprise a first support arm, a second support arm, and a third support arm, and the at least one channel defined on each support arm comprises a first channel and a second channel, the first and second channels being spaced apart about 180° from each other and disposed within a horizontal plane extending through the support arms;

the at least one light shelf comprises a first light shelf and a second light shelf, and the first light shelf being slidably engaged between the first support arm and the second support arm, and the second light shelf being slidably engaged between the second support arm and the third support arm.

30. A method of assembling a light shelf assembly, the method comprising the steps of:

providing at least three support arms, each support arm having a first end and a second end, and each support arm defining at least a first channel extending from the second end toward the first end, wherein at least one of the at least three support arms defines a second channel extending from the second end toward the first end and being spaced apart from the at least first channel of the second of the at least three support arms;

providing at least two light shelves, each of the two light shelves comprising a substantially planar base portion, the base portion having a reflective upper surface, a first side and a second side, the second side being opposite and spaced apart from the first side, and at least one protrusion extending outwardly from each of the first and second side surfaces;

securing the first ends of the support arms to an interior wall of a building such that the support arms are spaced apart horizontally along the interior wall and an opening defined by the channel is within a horizontal plane that extends between two adjacent support arms;

slidably disposing the protrusions of the light shelves in the channels of the support arms such that back edge surfaces of the base portions of the light shelves are disposed adjacent the first ends of the support arms, and the first of the at least two light shelves is suspended between first and second of the at least three support arms, and the second of the two light shelves is suspended between the second and a third of the at least three support arms.

31. The method of claim 30, wherein each of the at least one protrusion comprises a first pin and a second pin extending from each side surface of the base portions, the first pins being adjacent the back edge surfaces of the base portions and the second pins being adjacent the front edge surfaces of the base portions, and the method further comprises the step of slidably disengaging the second pins from the channels of the support arms and rotating at least one of the light shelves about the first pins.

32. A light shelf assembly comprising:

two or more support arms spaced apart substantially horizontally along an interior wall of a building, each support arm having a first end and a second end, the first end being secured to the interior wall and the second end extending away from the interior wall and being spaced apart from the interior wall, and each support arm defining at least one protrusion that extends radially outwardly from an outer surface of the support arm, wherein the at least one protrusion comprises at least a first pivot member and a second portion and wherein a gap is formed between the first pivot member and the second portion; and at least one light shelf comprising a substantially planar base portion, the base portion having a reflective upper surface, a first side surface and a second side surface, the first side surface being opposite and spaced apart from the second side surface, the first side surface defining at least one channel extending along the first side surface and the second side surface defining at least one channel extending along the second side surface, wherein:

the at least one channels on each side surface define an opening, the protrusions on each support arm are substantially within a horizontal plane that extends between two adjacent support arms, and the at least one protrusion of the support arm adjacent the first side surface slidably engages the opening of the at least one channel defined on the first side surface and the at least one protrusion of the support arm adjacent the second side surface slidably engages the opening of the at least one channel defined on the second side surface such that a back edge surface of the base portion is disposed adjacent the first ends of the support arms, a front edge surface of the base portion is disposed adjacent the second ends of the support arms, and the light shelf is suspended between the support arms, and the light shelf is pivotable about the first pivot members of the two or more support arms when the second portions of the two or more support arms are slidably disengaged from the channels of each of the side surfaces of the light shelf.

* * * * *